US009399929B2

(12) United States Patent
Goto et al.

(10) Patent No.: US 9,399,929 B2
(45) Date of Patent: Jul. 26, 2016

(54) STEAM TURBINE PLANT

(75) Inventors: Koichi Goto, Yokohama (JP); Nobuo Okita, Ushiku (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 386 days.

(21) Appl. No.: 13/272,755

(22) Filed: Oct. 13, 2011

(65) Prior Publication Data

US 2012/0266598 A1 Oct. 25, 2012

(30) Foreign Application Priority Data

Oct. 19, 2010 (JP) ..... 2010-234804
Jul. 27, 2011 (JP) ..... 2011-164621

(51) Int. Cl.

| | |
|---|---|
| ***F01K 7/22*** | (2006.01) |
| ***F01K 7/40*** | (2006.01) |
| ***F01K 13/00*** | (2006.01) |
| ***F22B 1/00*** | (2006.01) |

(52) U.S. Cl.

CPC . *F01K 7/223* (2013.01); *F01K 7/22* (2013.01); *F01K 7/40* (2013.01); *F01K 13/00* (2013.01); *F22B 1/006* (2013.01)

(58) Field of Classification Search

CPC ..... F01K 7/22; F01K 7/40; F01K 7/223; F01K 13/00; F22B 1/006
USPC ..... 60/653, 654, 661–662, 677–680
See application file for complete search history.

(56) References Cited

U.S. PATENT DOCUMENTS 3,289,408 A * 12/1966 Silvestri, Jr. ..... 60/678
3,518,830 A * 7/1970 Dunnavant et al. ..... 60/657
3,921,406 A 11/1975 Teranishi et al.
4,561,255 A * 12/1985 Silvestri, Jr. ..... 60/678
5,377,489 A * 1/1995 Silvestri, Jr. ..... F01K 7/40 165/113
5,526,386 A * 6/1996 Tsiklauri et al. ..... 376/317
6,422,017 B1 * 7/2002 Bassily ..... 60/653
6,742,336 B2 * 6/2004 Itou et al. ..... 60/646
7,147,427 B1 * 12/2006 Campbell ..... 415/1

(Continued)

FOREIGN PATENT DOCUMENTS

AU 2011201549 B2 4/2011
CN 1182466 A 5/1998

(Continued)

OTHER PUBLICATIONS

U.S. Appl. No. 13/273,469, filed Oct. 14, 2011, Goto et al.

(Continued)

*Primary Examiner* — Hoang Nguyen
(74) *Attorney, Agent, or Firm* — Foley & Lardner LLP

(57) ABSTRACT

A steam turbine plant of one embodiment includes a boiler to change water into steam, a high pressure turbine including plural stages of rotor and stator vanes and to be driven by the steam from the boiler, a reheater to heat the steam from the high pressure turbine, a reheat turbine including plural stages of rotor and stator vanes and to be driven by the steam from the reheater, a condenser to change the steam from the reheat turbine into water, a collector to collect water from, for example, the steam existing upstream of an inlet of the final-stage rotor vane in the high pressure turbine, and a path to cause collected matter in the collector to flow into, for example, the steam between an outlet of the final-stage rotor vane of the high pressure turbine and an inlet of the final-stage rotor vane of the reheat turbine.

11 Claims, 16 Drawing Sheets

(56) References Cited

U.S. PATENT DOCUMENTS

| | | | | |
|---|---|---|---|---|
| 7,614,233 | B2 * | 11/2009 | Chaki et al. | 60/644.1 |
| 2009/0025387 | A1 * | 1/2009 | Willson et al. | 60/653 |
| 2011/0056201 | A1 * | 3/2011 | Kluge et al. | 60/653 |
| 2012/0000202 | A1 | 1/2012 | Menendez Salcedo et al. | |

FOREIGN PATENT DOCUMENTS

| | | | |
|---|---|---|---|
| EP | 1 965 043 | A1 | 9/2008 |
| EP | 2 264 287 | A1 | 12/2010 |
| FR | 2.098.833 | A5 | 3/1972 |
| GB | 891136 | | 3/1962 |
| GB | 1 238 352 | A | 7/1971 |
| JP | 63-075403 | | 4/1988 |
| JP | H01-277606 | A | 11/1989 |
| JP | 09-250306 | A | 9/1997 |
| JP | 11-022410 | A | 1/1999 |
| JP | 11-159302 | A | 6/1999 |
| JP | 2004-124751 | A | 4/2004 |
| JP | 2006-242083 | A | 9/2006 |
| WO | WO 96/29507 | A2 | 9/1996 |
| WO | WO 2005/031123 | A1 | 4/2005 |
| WO | WO 2009/106657 | A1 | 9/2009 |

OTHER PUBLICATIONS

Australian Office Action dated Oct. 30, 2013 issued in connection with counterpart of U.S. Appl. No. 13/273,469, 4 pages.
K. Goto, U.S. PTO Official Action, U.S. Appl. No. 13/273,469, dated Nov. 27, 2013, 14 pages.
Australian Office Action dated Feb. 3, 2014 issued in connection with counterpart of U.S. Appl. No. 13/273,469, 4 pages.
K. Goto, U.S. PTO Official Action, U.S. Appl. No. 13/273,469, dated Mar. 13, 2014, 10 pages.
Australian Office Action issue in corresponding Application No. 2011236116 of U.S. Appl. No. 13/273,469, dated May 12, 2014.
K. Goto, U.S. PTO Official Action, U.S. Appl. No. 13/273,469, dated Jul. 17, 2014, 8 pages.
K. Goto, U.S. PTO Official Action, U.S. Appl. No. 13/273,469, dated Oct. 24, 2014, 10 pages.
K. Goto, U.S. PTO Official Action, U.S. Appl. No. 13/273,469, dated Jan. 26, 2015, 9 pages.
K. Goto, U.S. PTO Official Action, U.S. Appl. No. 13/273,469, dated May 11, 2015, 13 pages.
Australian Office Action, Application No. 2014202430, dated Jul. 23, 2015, 3 pages.
Australian Office Action, Application No. 2014210578, dated Aug. 13, 2015, 3 pages.
K. Goto, U.S. PTO Official Action, U.S. Appl. No. 13/273,469, dated Aug. 17, 2015, 8 pages.
European Office Action issued in Application No. 11185576.3, dated Dec. 8, 2015.
U.S. Office Action issued in U.S. Appl. No. 13/273,469, dated Nov. 24, 2015
Australian Office Action, Application No. 2014210578, dated Mar. 1, 2016, 4 pages.
US Office Action, corresponding U.S. Appl. No. 13/273,469, dated Mar. 22, 2016, 5 pages.

* cited by examiner

STEAM TURBINE PLANT

CROSS REFERENCE TO RELATED APPLICATION

This application is based upon and claims the benefit of priority from the prior Japanese Patent Applications No. 2010-234804, filed on Oct. 19, 2010 and No. 2011-164621, filed on Jul. 27, 2011, the entire contents of which are incorporated herein by reference.

BACKGROUND OF THE INVENTION

1. Field of the Invention

The present invention relates to a steam turbine plant, for example, including a collector configured to collect water from steam in a high pressure turbine or stream exhausted from the high pressure turbine.

2. Background Art

FIG. 22 is a schematic diagram illustrating a first example of a conventional steam turbine plant using solar heat. A steam turbine cycle in the plant of FIG. 22 will be described.

A heat medium 118 is transferred by a heat medium pump 116 to a solar energy collector 119 collecting solar heat. The heat medium 118 is, for example, oil. The heat medium 118 is heated by radiant heat of solar rays 117 in the solar energy collector 119. Subsequently, the heat medium 118 is transferred to a heater 110 which is a heat exchanger to heat water or steam corresponding to a heating object. The heat medium 118 decreases in the temperature in the heater 110, and returns to the upstream of the heat medium pump 116. In this manner, the heat medium 118 circulates.

The heat medium 118 stored in a heat storage tank is circulated while bypassing the solar energy collector 119 at nighttime when solar rays 117 cannot be received or daytime when the solar rays 117 are weak, but the equipment and the flow for this configuration are not shown herein.

The steam turbine cycle of FIG. 22 is configured as a single-stage reheat cycle which is a reheat turbine 113 including a high pressure turbine 101, an intermediate pressure turbine 102, and a low pressure turbine 103.

The heater 110 includes a boiler 108 which changes feed-water 111 into steam 112 and a reheater 109 which heats steam dedicated for the reheat turbine 113. The feed-water 111 is transferred by the pump 105 to the boiler 108 which is a part of the heater 110 and is heated in the boiler 108, so that it changes into the high pressure turbine inlet steam 112.

The high pressure turbine inlet steam 112 flows into the high pressure turbine 101 and expands inside the high pressure turbine 101, so that the pressure and the temperature all decrease. The high pressure turbine 101 is driven by the high pressure turbine inlet steam 112. In the steam turbine cycle using solar heat, the temperature of the high pressure turbine inlet steam 112 is low in many cases compared to the steam turbine cycle using exhaust heat of a combustion gas of a fuel. For this reason, the high pressure turbine exhaust 114 is not dry steam only composed of a gas, but humid steam composed of a mixture of a gas and a liquid. That is, the dryness of the humid steam is less than 1 in many cases.

In FIG. 22, the outlet (exhaust port) located at the most downstream of the high pressure turbine 101 is denoted by the reference character X. The high pressure turbine exhaust 114 flows into the reheater 109 which is a part of the heater 110 to be heated therein, and flows into the intermediate pressure turbine 102.

The intermediate pressure turbine inlet steam 106 expands inside the intermediate pressure turbine 102, decreases in both the pressure and the temperature, and flows into the low pressure turbine 103. The low pressure turbine 103 of FIG. 22 is a double flow type in which the intermediate pressure turbine exhaust 123 flows from the center of the low pressure turbine 103 left and right, and flows out of two outlets. The steam flowing into the low pressure turbine 103 expands inside the low pressure turbine 103, decreases in both the pressure and the temperature, and flows out as humid steam. Due to this steam, the intermediate pressure turbine 102 and the low pressure turbine 103 are driven as in the high pressure turbine 101.

The steam flowing out of the low pressure turbine 103, the low pressure turbine exhaust 115 flows into a condenser 104. The condenser 104 cools the low pressure turbine exhaust 115 using cooling water, and returns the cooled exhaust to the feed-water 111. The feed-water 111 is returned to the upstream of the pump 105. In this manner, the feed-water 111 circulates while changing into the steam 112. Furthermore, seawater or stream water may be used as the cooling water, and the cooling water increasing in the temperature in the condenser 104 may be circulated by being cooled in a cooling tower using atmosphere.

The rotary shafts of the high pressure turbine 101, the intermediate pressure turbine 102, and the low pressure turbine 103 are connected to a generator 107. Its rotary shaft is rotated with the rotation of the high pressure turbine 101, the intermediate pressure turbine 102, and the low pressure turbine 103 due to the expanding steam. The generator 107 generates power in accordance with the rotation of the rotary shaft.

In FIG. 22, the extraction ports provided at the halfway stages of the high pressure turbine 101, the intermediate pressure turbine 102, and the low pressure turbine 103 are denoted by the reference character E, and extraction steam 120 is extracted from one or more of the extraction ports E. In FIG. 22, a recycling cycle (a reheat recycling cycle) is configured such that the feed-water 111 is heated by the extraction steam 120 serving as a heat source in the feed-water heater 121 between the condenser 104 and the boiler 108. The cycle of FIG. 22 may not be the recycling cycle, but the efficiency of the cycle improves in the case of the recycling cycle.

Furthermore, the extraction steam 120 is cooled in the feed-water heater 121 to change into water, and merges with the feed-water 111 by a drain water pump 122.

FIG. 23 is a schematic diagram illustrating a second example of the conventional steam turbine plant using solar heat. In FIG. 23, the flow of the heat medium 118 is not shown, and this will be omitted even in the respective drawings to be described later.

In many cases, the inlet steam of the reheat cycle using solar heat is close to a humid region with, for example, a pressure of 110 ata and a temperature of 380° C. in the enthalpy-entropy diagrammatic view, and the high pressure turbine exhaust 114 becomes humid steam. The humid steam inside the high pressure turbine 101 causes humidity loss, and deteriorates the internal efficiency of the turbine. Further, since water droplets collide with the surface of the turbine vane of the high pressure turbine 101, erosion is caused.

Therefore, the high pressure turbine 101 of FIG. 23 includes a collector which collects water from the steam inside the high pressure turbine 101. Then, the steam turbine plant of FIG. 23 includes a collected matter path P which makes collected matter 201 collected by the collector flow into the condenser 104. In FIG. 23, the collection place where water is collected from the high pressure turbine 101 is denoted by the reference character Y. The collected matter 201 flows from the collection place Y into the condenser 104 through the collected matter path P. In some cases, the collected matter 201 may contain humid steam or dry steam collected with water as well as the collected water.

Hereinafter, first to third configuration examples of the collector will be described.

FIG. 24 is a schematic diagram illustrating a first example of the collector.

As shown in FIG. 24, the high pressure turbine 101 includes plural stages of rotor vanes 301 and plural stages of stator vanes 302. Then, in FIG. 24, a drain catcher 304 is provided at an inner wall surface 303 on the outer peripheral side of the steam passage. The drain catcher 304 is the first configuration example of the collector.

The drain catcher 304 is connected to the condenser 104 through the pipe (the collected matter path P). Since the internal pressure of the condenser 104 is lower than that of the high pressure turbine 101, moisture present in the inner wall surface 303 is suctioned outward as the collected matter 201, and flows into the condenser 104. Accordingly, the amount of the moisture contained in the steam inside the high pressure turbine 101 decreases.

FIG. 25 is a schematic diagram illustrating a second example of the collector.

There is shown a groove attached rotor vane 311 configured to more actively remove moisture than the first configuration example. In FIG. 25, a groove 305 is provided at a surface of a rotor vane 301 (311) of a turbine stage to which humid steam flows, so that water droplets 306 contained in the humid steam are captured. The captured water droplets 306 move toward the outer periphery of the rotor vane 301 along the groove 305 due to the centrifugal force exerted on the surface of the rotating rotor vane 301. Then, the water droplets 306 fly toward the drain catcher 304 provided on the inner wall surface 303.

The drain catcher 304 is connected to the condenser 104 through the pipe (the collected matter path P). Since the internal pressure of the condenser 104 is lower than that of the high pressure turbine 101, the moisture present inside the drain catcher 304 is suctioned outward as the collected matter 201, and flows into the condenser 104. Accordingly, the amount of the moisture contained in the steam inside the high pressure turbine 101 decreases. The drain catcher 304 and the groove attached rotor vane 311 are the second configuration example of the collector.

The collector shown in FIG. 24 or 25 may be provided in the intermediate pressure turbine 102 or the low pressure turbine 103 so long as it is a turbine stage to which humid steam flows. However, when the groove attached rotor vane 311 is applied to the final-stage rotor vane 301 of the low pressure turbine 103, no effect is obtained since there is no rotor vane 301 at the downstream of the final-stage rotor vane. For this reason, the groove attached rotor vane 311 is applied to the rotor vane 301 which is located upstream of the final-stage rotor vane 301 of the low pressure turbine 103.

FIGS. 26 to 28 are schematic diagrams illustrating a third example of the collector.

There is shown a slit attached stator vane 312 configured to more actively remove moisture than the first configuration example. FIG. 26 is a diagram when the slit attached stator vane 312 is seen from the cross-section including the rotary shaft of the turbine, and FIG. 27 is a diagram when the slit attached stator vane 312 is seen from the cross-section perpendicular to the rotary shaft of the turbine. Further, FIG. 28 is a diagram illustrating the cross-section perpendicular to the radial direction with respect to one slit attached stator vane 312.

In FIGS. 26 to 28, a slit 307 is provided on the surface of the stator vane 302 (312) at the turbine stage to which humid steam flows. In addition, a hollow space 308 is provided inside the stator vane 312, and the stator vane 312 is configured as a hollow vane. The surface of the stator vane 312 and the hollow space 308 are connected to each other through the slit 307. The slit attached stator vane 312 is the third configuration example of the collector.

The hollow space 308 is connected to the condenser 104 through the slit 307 and the pipe (the collected matter path P). Since the internal pressure of the condenser 104 is lower than that of the vicinity of the slit 307, the water droplets 306 or the water membrane flowing to the surface of the slit attached stator vane 312 are suctioned outward as the collected matter 201, and flows into the condenser 104. Accordingly, the amount of the moisture contained in the high pressure turbine 101 decreases.

Further, the water droplets 306 or the water membrane flowing to the surface of the stator vane 302 are separated from the surface of the stator vane 302 in the form of water droplets and scatter to the downstream, so that the water droplets collide with the downstream rotor vane 301. However, according to the slit attached stator vane 312, the amount of the water droplets 306 especially decreases in this manner.

The collector shown in FIGS. 26 to 28 may be provided in the intermediate pressure turbine 102 or the low pressure turbine 103 so long as it is a turbine stage to which humid steam flows.

Furthermore, since the low pressure turbine exhaust 115 decreases in the pressure until it changes into humid steam regardless of the property and the state of the inlet steam, in the steam turbine cycle using solar heat, the high pressure turbine exhaust 114 and the low pressure turbine exhaust 115 are humid steam.

FIG. 29 is a diagram illustrating an example of an expansion line of the conventional steam turbine plant shown in FIG. 22 or 23. The vertical axis of FIG. 29 indicates the enthalpy, and the horizontal axis indicates the entropy.

In FIG. 29, there are shown a high pressure turbine expansion line 401, a reheat turbine expansion line 402, and a saturation line 403. Since the intermediate pressure turbine 102 and the low pressure turbine 103 are reheat turbines continuous to each other, the expansion line for such a turbine becomes one expansion line.

In FIG. 29, there are shown a high pressure turbine inlet point 404, a high pressure turbine outlet point 405, a reheat turbine inlet point (an intermediate pressure turbine inlet point) 406, and a reheat turbine outlet point (a low pressure turbine outlet point) 407.

In FIG. 29, the high pressure turbine exhaust 114 is heated in the reheater 109 up to a temperature equal to that of the high pressure turbine inlet steam 112. Further, in FIG. 29, there is a change exceeding the saturation line 403 when the steam changes from the high pressure turbine inlet point 404 to the high pressure turbine outlet point 405 or from the reheat turbine inlet point 406 to the reheat turbine outlet point 407. Therefore, in the high pressure turbine inlet point 404 or the reheat turbine inlet point 406, the steam is dry steam. In the high pressure turbine outlet point 405 or the reheat turbine outlet point 407, the steam is humid steam.

FIG. 29 relates to the high pressure turbine expansion line 401, where there are shown a dry region $R_1$ in which the steam is dry steam and a humid region $R_3$ in which the steam is humid steam. FIG. 29 relates to the reheat turbine expansion line 402, where there are shown a dry region $R_2$ in which the steam is dry steam and a humid region $R_4$ in which the steam is humid steam.

Furthermore, JP-A 2006-242083 (KOKAI) discloses an example of a steam turbine plant that is equipped with a moisture separator.

Further, JP-A H11-22410 (KOKAI), JP-A 2004-124751 (KOKAI), and JP-A H11-159302 (KOKAI) disclose examples of a steam turbine plant that is equipped with a collector for collecting moisture.

SUMMARY OF THE INVENTION

In FIG. 23, when moisture is removed from the high pressure turbine 101, the flow rate of the steam of all downstream turbines decreases as much as the extracted moisture. For this reason, the output of the power generation of the plant decreases, and the performance of the steam turbine cycle deteriorates. The performance of the steam turbine cycle is, for example, the output of the power generation per unit heat input, and the performance of the steam turbine cycle becomes better as the value thereof becomes larger. Furthermore, all downstream turbines include the turbine stage at the downstream of the extraction position of the moisture in the high pressure turbine 101, the intermediate pressure turbine 102, and the low pressure turbine 103.

Further, in the case of the application of the slit attached stator vane 312, the humid steam is also suctioned when the moisture on the surface of the vane is suctioned out of the slit 307. The humid steam is composed of water and gaseous steam. For this reason, the gaseous steam is suctioned outward at the time of the suction, and the amount of the fluid for driving the turbine decreases.

In FIG. 23, a valve 202 is provided on a suction line (a collected matter path P) from the collector to the condenser 104. Then, a difference in the suction pressure (here, a difference in the pressure between the vicinity of the slit 307 and the condenser 104) is adjusted on the basis of the opening degree of the valve 202 so that the suction amount of the accompanying steam decreases when the moisture on the surface of the vane is suctioned.

However, since it is extremely difficult to suction only the moisture on the surface of the vane without suctioning the accompanying steam, the flow rate of the steam of all downstream turbines decreases as much as the amount of the accompanying steam. For this reason, the output of the power generation of the plant decreases, and the performance of the steam turbine cycle deteriorates. Although the enthalpy of the accompanying steam is sufficiently high and the enthalpy of the accompanying steam can be extracted at the turbine different from the water, in FIG. 23, the enthalpy is exhausted to the condenser 104 without any extraction thereof. Accordingly, the output of the power generation decreases even in the high pressure turbine 101.

Further, the moisture exhausted from the high pressure turbine 101 is sufficiently high temperature inside the high pressure turbine 101, but if the moisture is not removed, the moisture is heated by the reheater 109 to change into steam, and the enthalpy is extracted from the intermediate pressure turbine 102 and the low pressure turbine 103. However, when the moisture exhausted from the high pressure turbine 101 is removed, the sufficient sensible heat of the moisture is discarded to the condenser 104 without any use, so that the performance of the steam turbine cycle deteriorates.

Therefore, an object of the invention is to provide a steam turbine plant capable of reducing deterioration in the output of the power generation and deterioration in the performance of the steam turbine cycle with the removal of moisture when the moisture is removed from the steam inside the high pressure turbine 101 or the exhaust of the high pressure turbine 101.

An aspect of the present invention is, for example, a steam turbine plant including a boiler configured to change water into steam, a high pressure turbine including plural stages of rotor vanes and plural stages of stator vanes, and configured to be driven by the steam from the boiler, a reheater configured to heat the steam exhausted from the high pressure turbine, a reheat turbine including plural stages of rotor vanes and plural stages of stator vanes, and configured to be driven by the steam from the reheater, a condenser configured to change the steam exhausted from the reheat turbine into water, a collector configured to collect water from the steam which exists upstream of an inlet of the final-stage rotor vane in the high pressure turbine, or from the steam exhausted from the high pressure turbine, and a collected matter path configured to cause collected matter in the collector to flow into the steam between an outlet of the final-stage rotor vane of the high pressure turbine and an inlet of the final-stage rotor vane of the reheat turbine, the steam between a collection place of the collected matter and the inlet of the final-stage rotor vane in the high pressure turbine, the water between the condenser and the boiler, the steam extracted from an extraction port of the high pressure turbine or the reheat turbine, a feed-water heater configured to receive the extracted steam from the extraction port, or a feed-water pump driving steam turbine configured to receive the extracted steam from the extraction port.

DESCRIPTION OF THE EMBODIMENTS

Embodiments of the invention will now be explained with reference to the accompanying drawings.

First Embodiment

Figure 1:
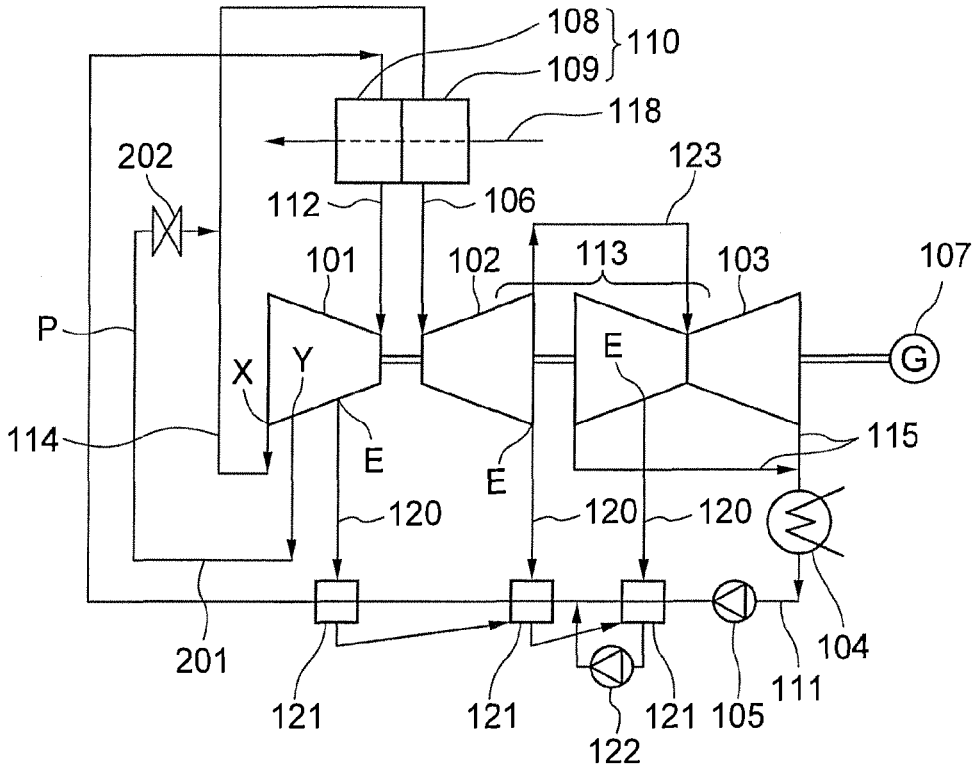
FIG. 1 is a schematic diagram illustrating a configuration of a steam turbine plant of a first embodiment.

FIG. 1 is a schematic diagram illustrating a configuration of a steam turbine plant of a first embodiment. Regarding the configuration shown in FIG. 1, differences from the configurations shown in FIGS. 22 and 23 will be mainly described.

Figure 22:
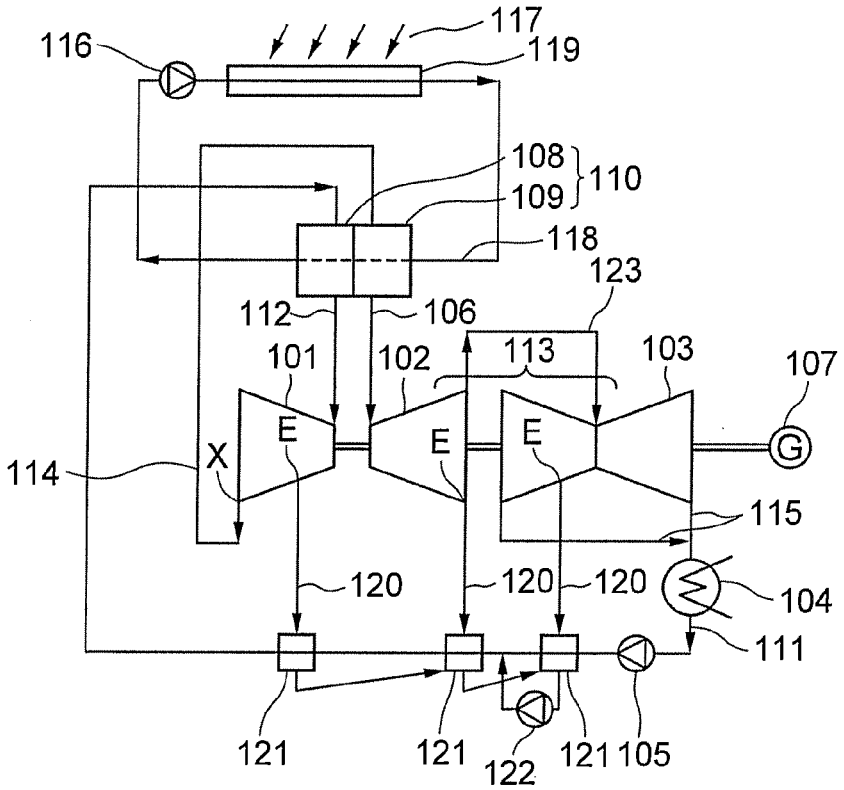
FIG. 22 is a schematic diagram illustrating a first example of a conventional steam turbine plant.
Figure 23:
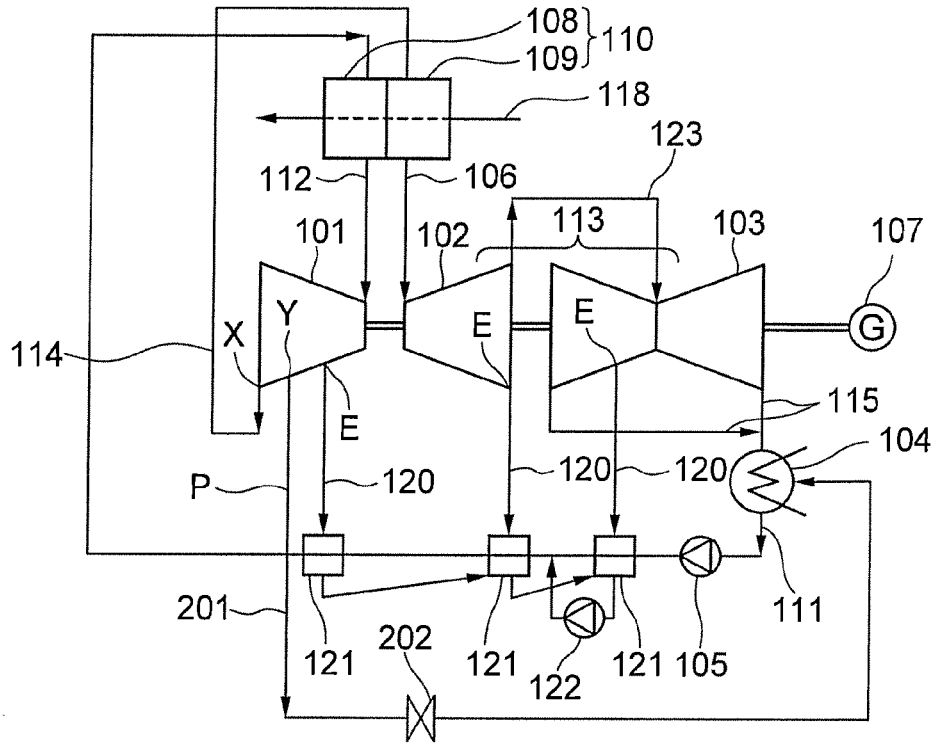
FIG. 23 is a schematic diagram illustrating a second example of a conventional steam turbine plant.

The steam turbine plant of the embodiment is configured as a reheat cycle as in the steam turbine plant shown in FIG. 22 or 23, where a high pressure turbine 101 is installed upstream of a reheater 109, and a reheat turbine 113 including an intermediate pressure turbine 102 and a low pressure turbine 103 is installed at the downstream of the reheater 109.

Figure 24:
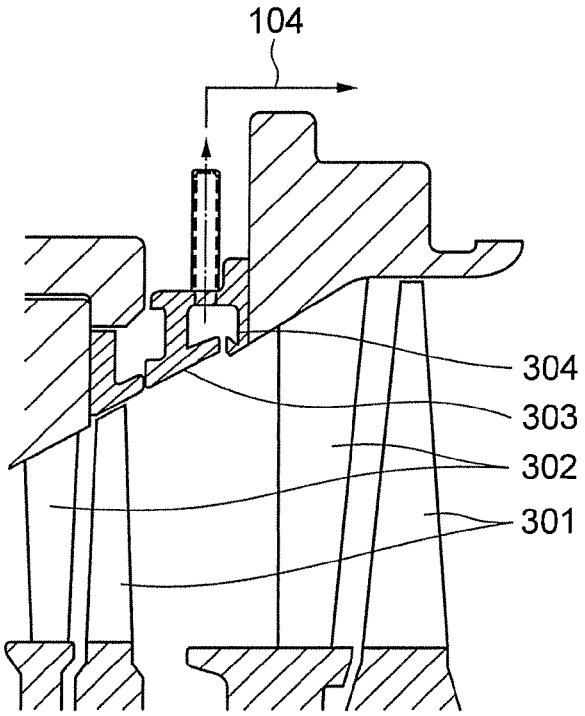
FIG. 24 is a schematic diagram illustrating a first example of a collector.

Further, the high pressure turbine 101 of the embodiment includes plural stages of rotor vanes 301 and plural stages of stator vanes 302 as in the high pressure turbine 101 shown in FIG. 22 or 23 (refer to FIG. 24). In the same manner, the reheat turbine 113 of the embodiment includes plural stages of rotor vanes and plural stages of stator vanes. Further, the high pressure turbine 101 of the embodiment includes one turbine or a plurality of turbines connected to each other in series. On the other hand, the reheat turbine 113 of the embodiment includes the plurality of turbines connected to each other in series, but may include one turbine.

Figure 28:
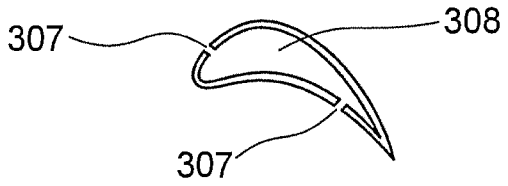
FIG. 28 is another schematic diagram illustrating the third example of the collector.
Figure 29:
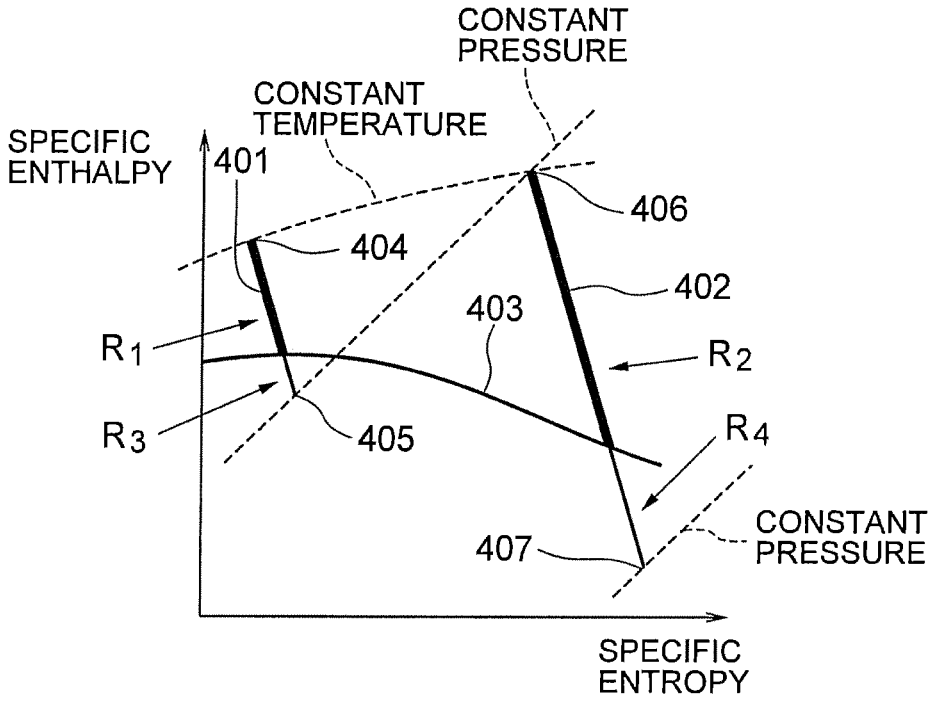
FIG. 29 is a diagram illustrating an example of an expansion line of a conventional steam turbine plant.

Further, in the high pressure turbine 101 of the embodiment, the steam circulating therein changes into humid steam as in the high pressure turbine 101 shown in FIG. 22 or 23 (refer to FIG. 29). Therefore, the high pressure turbine 101 of the embodiment is provided with a collector that collects moisture from the steam inside the high pressure turbine 101. Examples of the collector include a drain catcher 304 shown in FIG. 24, a drain catcher 304 and a groove attached rotor vane 311 shown in FIG. 25, a slit attached stator vane 312 shown in FIGS. 26 to 28, and the like.

Furthermore, in the embodiment, the collector is disposed at a position where moisture is collected from the steam which exists upstream of the inlet of the final-stage rotor vane 301 inside the high pressure turbine 101. Further, in the embodiment, the collector is disposed at a position where moisture is collected from the steam of the humid region $R_3$ in FIG. 29.

Collected matter 201 obtained by the collector is moisture when the collector is the drain catcher 304 or the drain catcher 304 and the groove attached rotor vane 311, and is moisture and accompanying steam when the collector is the slit attached stator vane 312.

The steam turbine plant of the embodiment includes a collected matter path P which makes the collected matter 201 flow into not a condenser 104, but the steam between the outlet of the final-stage rotor vane 301 of the high pressure turbine 101 and the inlet of the final-stage rotor vane of the reheat turbine 113. Specifically, the collected matter path P of the embodiment makes the collected matter 201 flow into a position between the high pressure turbine 101 and the reheater 109. However, when the collector is the slit attached stator vane 312, a difference in the suction pressure, that is, a difference in the pressure between the inflow place of the collected matter 201 and a slit 307 as the outflow place (the collection place Y) of the collected matter 201 is set to a degree that moisture may be sufficiently suctioned outward.

Moisture or moisture and accompanying steam collected as the collected matter 201 and merging with the upstream of the reheater 109 are heated by the reheater 109, and moisture therein is changed into steam, so that the intermediate pressure turbine 102 and the low pressure turbine 103 are driven.

In this case, the flow rate of the steam of the intermediate pressure turbine 102 and the low pressure turbine 103 located at the downstream of the high pressure turbine 101 does not decrease. Further, in this case, sensible heat of the moisture is utilized without being directly discarded to the condenser 104, and is finally used as a part of the output of the power generation. Further, when the collector is the slit attached stator vane 312, the enthalpy of the accompanying steam is utilized without being directly discarded to the condenser 104, and is used as a part of the output of the power generation in the intermediate pressure turbine 102 and the low pressure turbine 103.

Therefore, according to the embodiment, it is possible to reduce deterioration in the output of the power generation and deterioration in the performance of the steam turbine cycle with the removal of the moisture from the steam inside the high pressure turbine 101.

Furthermore, in the embodiment, the collector is disposed at a position where moisture is collected from the steam which exists upstream of the inlet of the final-stage rotor vane 301 inside the high pressure turbine 101. There are advantages in that the amount of the moisture contained in the steam behind the collection position inside the high pressure turbine 101 decreases, the moisture loss at the stage of the high pressure turbine after the collection position is reduced, and the internal efficiency of the turbine improves. Further, there is an advantage in that the erosion at the high pressure turbine vane after the collection position is reduced.

As described above, in the embodiment, the collected matter 201 is made to flow into not the condenser 104, but the steam between the outlet of the final-stage rotor vane 301 of the high pressure turbine 101 and the inlet of the final-stage rotor vane of the reheat turbine 113. Accordingly, when the moisture is removed from the steam inside the high pressure turbine 101, it is possible to reduce deterioration in the output of the power generation and deterioration in the performance of the steam turbine cycle with the removal of the moisture.

Hereinafter, second to twenty-seventh embodiments will be described. Since those embodiments are modifications of the first embodiment, those embodiments will be described by focusing on differences from the first embodiment.

Second Embodiment

Figure 2:
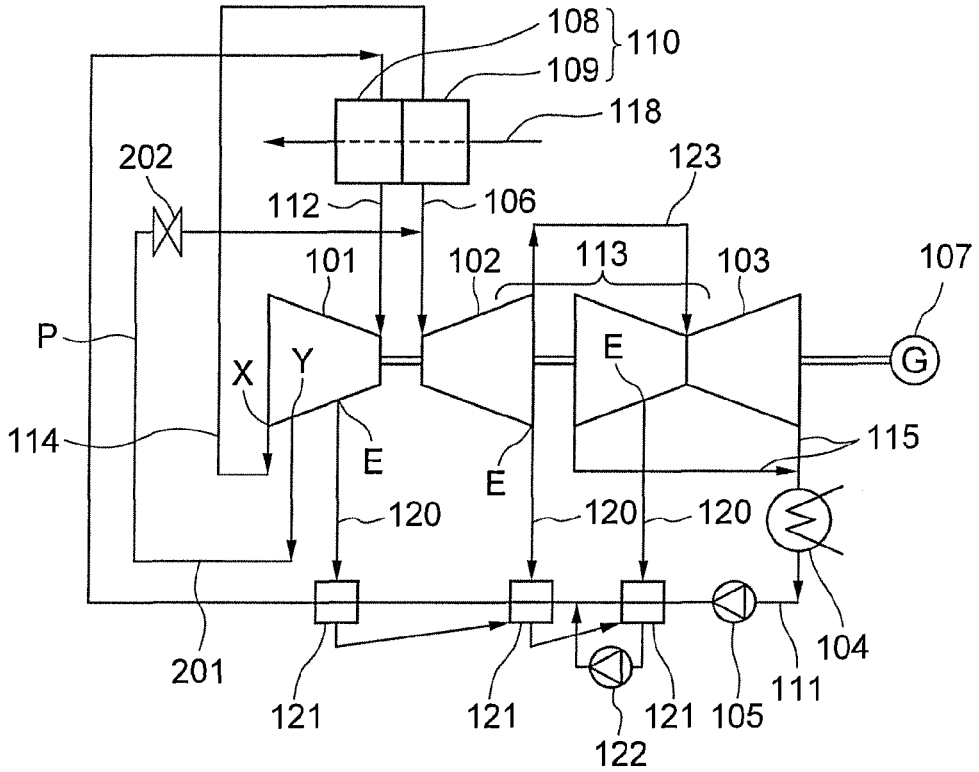
FIG. 2 is a schematic diagram illustrating a configuration of a steam turbine plant of a second embodiment.

FIG. 2 is a schematic diagram illustrating a configuration of the steam turbine plant of the second embodiment.

The collected matter path P of the embodiment makes the collected matter 201 flow into the inlet of the reheat turbine 113, that is, the inlet of the intermediate pressure turbine 102 or the passage between the reheater 109 and the intermediate pressure turbine 102. Since the amount of inflow moisture is extremely small compared to the peripheral steam, the inflow moisture changes into steam by being heated by the peripheral steam, and is used as a part of the steam for driving the reheat turbine 113.

When the collector is the slit attached stator vane 312, a difference in the suction pressure, that is, a difference in the pressure between the inflow place of the collected matter 201 and the vicinity of the slit 307 needs to be set to a degree that moisture may be sufficiently suctioned outward. The steam at the downstream of the reheater 109 decreases in the pressure as much as the pressure loss in the reheater 109, so that a difference in the suction pressure is easily ensured. If a difference in the suction pressure is too large, a difference in the pressure is adjusted on the basis of the opening degree of a valve 202.

Further, even when the collector is the drain catcher 304 or the drain catcher 304 and the groove attached rotor vane 311, there is a need to ensure a sufficient difference in the pressure between the inflow place and the outflow place of the collected matter 201, but in the embodiment, it is easy to ensure a difference in the pressure.

Here, the first embodiment and the second embodiment will be compared with each other.

In the first embodiment, since the collected matter 201 is made to flow into the upstream inflow place compared to the second embodiment, there is an advantage in that the performance of the steam turbine cycle may become more efficient. Especially, in the first embodiment, since the collected matter 201 is made to flow into the inflow place located upstream of the reheater 109, the collected matter 201 is heated by the reheater 109 before circulation, so that the performance of the steam turbine cycle becomes efficient.

On the other hand, in the second embodiment, since the collected matter 201 is made to flow into the downstream inflow place compared to the first embodiment, it is easy to ensure a difference in the pressure between the inflow place and the outflow place of the collected matter 201. As a result, there is an advantage in that the collected matter 201 easily flows into the inflow place.

According to the embodiment, when moisture is removed from the steam inside the high pressure turbine 101, it is possible to reduce deterioration in the output of the power generation and deterioration in the performance of the steam turbine cycle with the removal of the moisture, as in the first embodiment.

Third Embodiment

Figure 3:
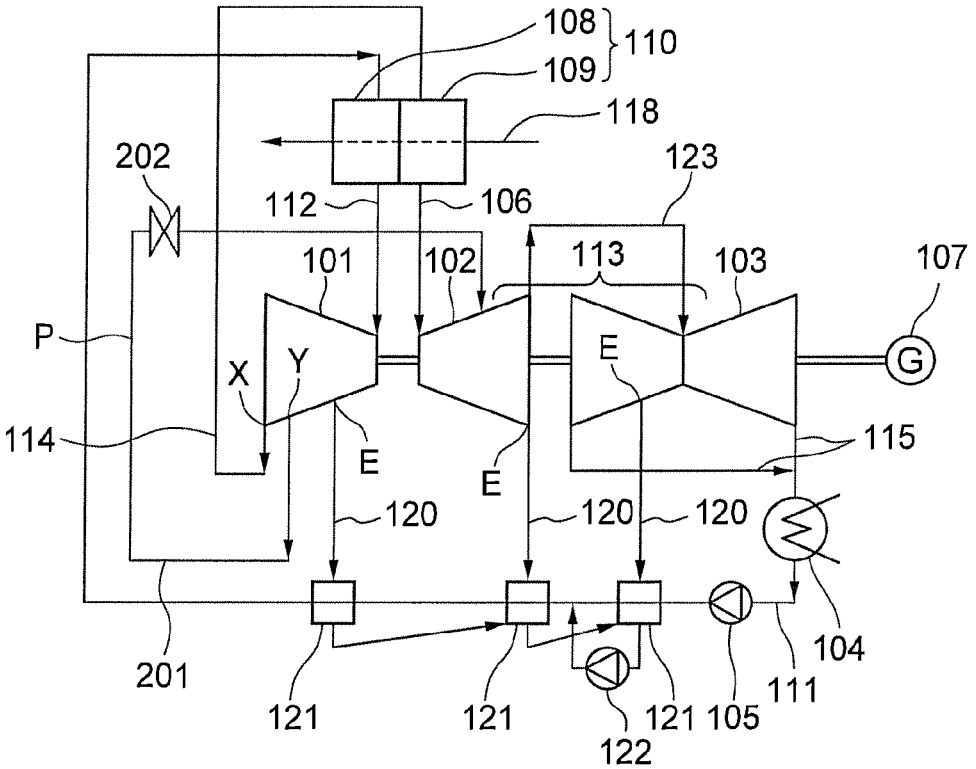
FIG. 3 is a schematic diagram illustrating a configuration of a steam turbine plant of a third embodiment.
Figure 4:
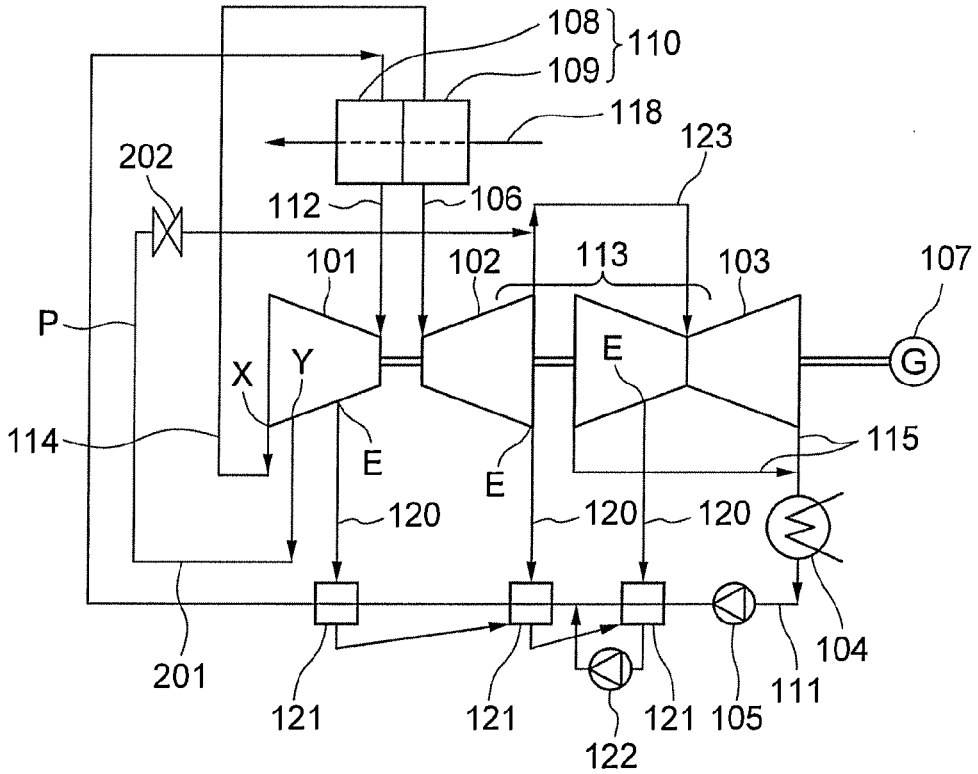
FIG. 4 is a schematic diagram illustrating another configuration of the steam turbine plant of the third embodiment.
Figure 5:
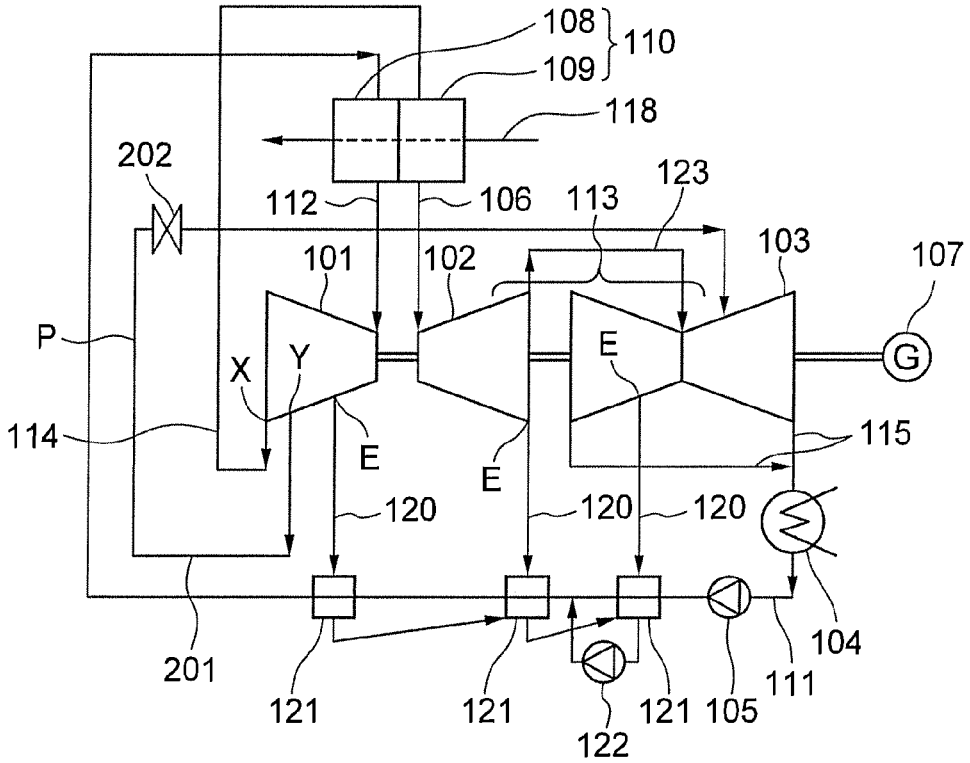
FIG. 5 is a schematic diagram illustrating another configuration of the steam turbine plant of the third embodiment.

FIGS. 3 to 5 are schematic diagrams illustrating a configuration of the steam turbine plant of the third embodiment.

The collected matter path P of the embodiment makes the collected matter 201 flow into a halfway stage of the reheat turbine 113, and more specifically, a position between the inlet of the intermediate pressure turbine 102 and the inlet of the final-stage rotor vane of the low pressure turbine 103 as the farthest downstream turbine. The inflow place of the collected matter 201 is the halfway stage of the intermediate pressure turbine 102 in FIG. 3, a position between the intermediate pressure turbine 102 and the low pressure turbine 103 in FIG. 4, and the halfway stage of the low pressure turbine 103 in FIG. 5. Since the amount of inflow moisture is extremely small compared to the peripheral steam, the inflow moisture changes into steam by being heated by the peripheral steam, and is used as a part of the steam for driving the reheat turbine 113 at the downstream of the inflow place.

In the embodiment, as in the second embodiment, there is a need to ensure a sufficient difference in the pressure between the inflow place and the outflow place of the collected matter 201. However, in the embodiment, it is possible to more easily ensure a difference in the pressure compared to the second embodiment since there is a decrease in the pressure not only due to the pressure loss in the reheater 109, but also decrease in the pressure in the turbine stage. In this manner, in the embodiment, there is an advantage in that a difference in the pressure is more easily ensured compared to the second embodiment.

According to the embodiment, when moisture is removed from the steam inside the high pressure turbine 101, it is possible to reduce deterioration in the output of the power generation and deterioration in the performance of the steam turbine cycle with the removal of the moisture, as in the first and second embodiments.

Fourth Embodiment

Figure 6:
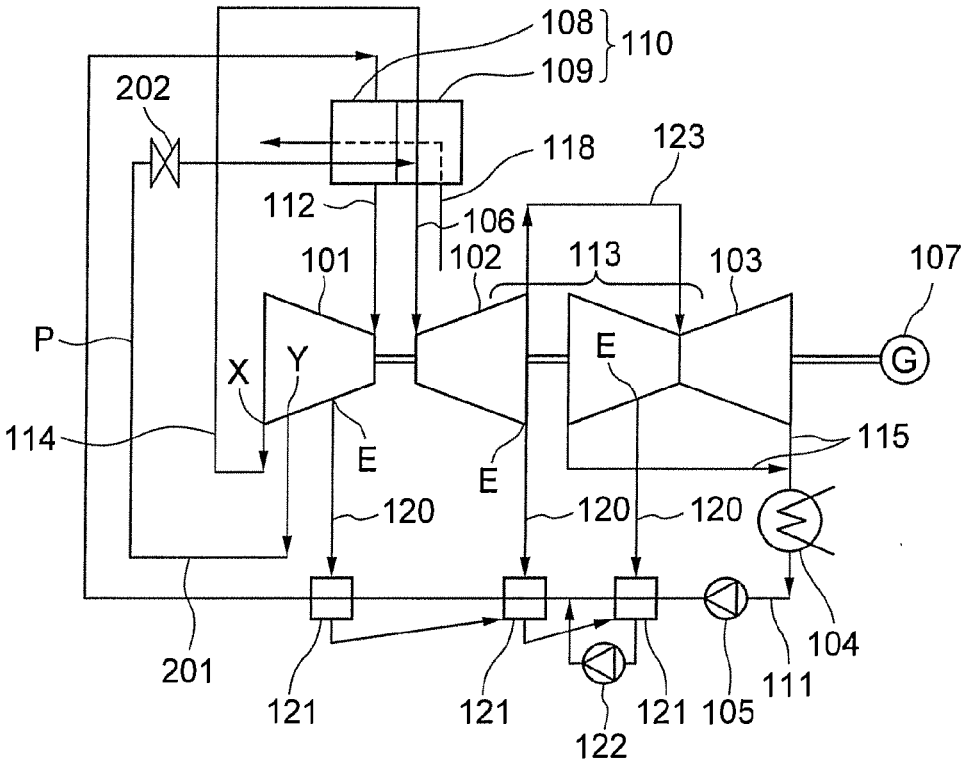
FIG. 6 is a schematic diagram illustrating a configuration of a steam turbine plant of a fourth embodiment.

FIG. 6 is a schematic diagram illustrating a configuration of the steam turbine plant of the fourth embodiment.

The collected matter path P of the embodiment makes the collected matter 201 flow into the reheater 109. Since the flow rate or the temperature of the collected matter 201 is set to an arbitrary value, in the second and third embodiments, it is difficult to adjust the temperature of the steam at the outlet of the reheater 109, that is, the temperature of the intermediate pressure turbine inlet steam 106.

On the contrary, in the embodiment, the collected matter 201 is made to flow into not the steam generated as the intermediate pressure turbine inlet steam 106, but the steam which is not completely heated as the intermediate pressure turbine inlet steam 106 inside the reheater 109. Therefore, in the embodiment, it is possible to adjust the temperature of the intermediate pressure turbine inlet steam 106 by adjusting the flow rate or the like of the heat medium 118.

Further, in the embodiment, since the steam at the inflow place of the collected matter 201 inside the reheater 109 decreases in the pressure as much as the pressure loss from the outflow place to the inflow place of the collected matter 201, it is easy to ensure a difference in the suction pressure compared to the first embodiment.

In this manner, in the embodiment, there is an advantage in that it is easy to ensure a difference in the suction pressure which easily adjusts the temperature of the intermediate pressure turbine inlet steam 106.

According to the embodiment, when moisture is removed from the steam inside the high pressure turbine 101, it is possible to reduce deterioration in the output of the power generation and deterioration in the performance of the steam turbine cycle with the removal of the moisture, as in the first to third embodiments.

Fifth Embodiment

Figure 7:
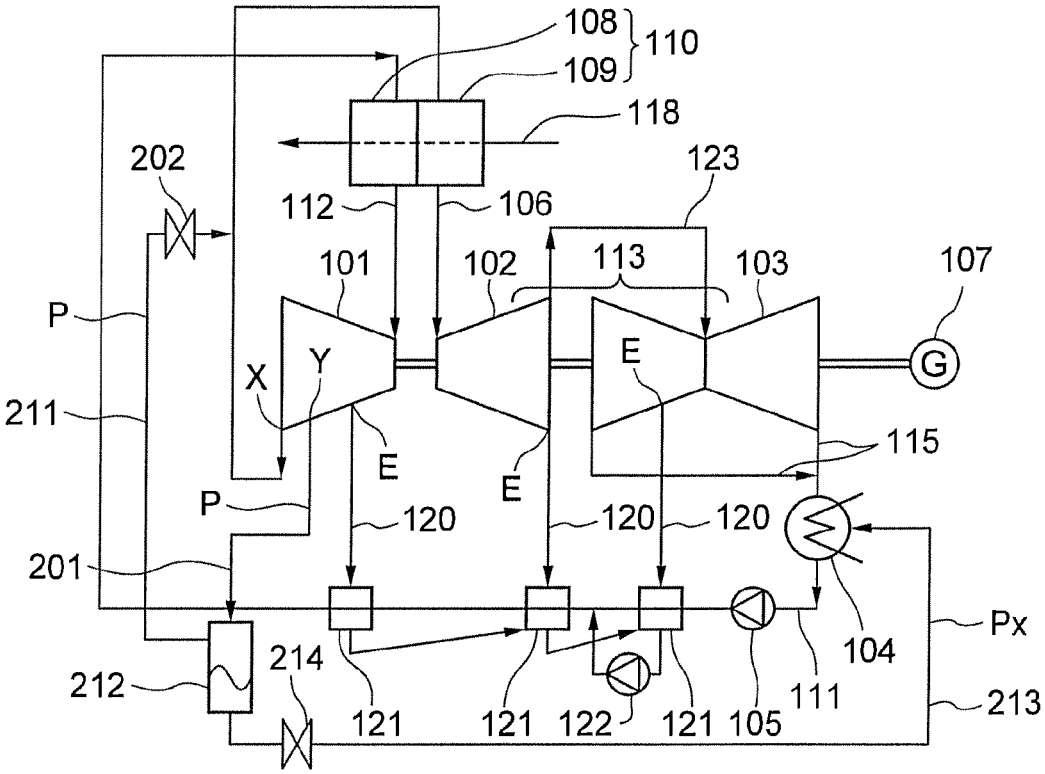
FIG. 7 is a schematic diagram illustrating a configuration of a steam turbine plant of a fifth embodiment.

FIG. 7 is a schematic diagram illustrating a configuration of the steam turbine plant of the fifth embodiment.

In the embodiment, a gas-liquid separator 212 is disposed on the collected matter path P, and the collected matter 201 is made to flow into the gas-liquid separator 212. The gas-liquid separator 212 separates the collected matter 201 into a gas 211 and a liquid 213. The gas 211 is steam, and the liquid 213 is water.

Subsequently, the gas 211 is made to flow into the steam by the collected matter path P, where the steam reaches from the outlet of the final-stage rotor vane 301 of the high pressure turbine 101 to the inlet of the final-stage rotor vane of the reheat turbine 113. On the other hand, the liquid 213 is made to flow into the condenser 104 by the separated liquid path Px. In the embodiment, a liquid passage valve 214 is provided on the separated liquid path Px.

In the embodiment, for example, the collected matter 201 collected from the slit attached stator vane 312 is inserted into a gas-liquid separation tank which is a type of the gas-liquid separator 211, and the collected matter 201 is separated into the gas 211 and the liquid 213 by the gravity.

When the collector is the drain catcher 304 or the drain catcher 304 and the groove attached rotor vane 311, the collected matter 201 is moisture. However, when the collected matter 201 is made to flow into the gas-liquid separation tank, a part of the collected matter 201 evaporates due to the pressure loss and the heat transfer up to the tank, so that the gas 211 and the liquid 213 are present inside the tank.

The separated gas 211 and the liquid 213 are respectively made to flow into the lower pressure place. The water as the liquid 213 is extracted from the bottom surface of the tank, and flows as the liquid 213 into the condenser 104. On the other hand, the steam as the gas 211 is extracted from the upside of the tank, and flows as the gas 211 into a position between the outlet of the final-stage rotor vane 301 of the high pressure turbine 101 and the inlet of the final-stage rotor vane of the reheat turbine 113. Furthermore, the separation of the gas 211 and the liquid 213 may be realized by a method such as a gas-liquid separation membrane other than the gas-liquid separation tank.

When the collector is the slit attached stator vane 312, the enthalpy of the accompanying steam is utilized without being directly discarded to the condenser 104, and is used as a part of the output of the power generation in the reheat turbine 113. Therefore, according to the embodiment, it is possible to reduce deterioration in the output of the power generation and deterioration in the performance of the turbine cycle with the removal of the moisture.

Further, in the embodiment, the gas-liquid separator 212 separates the collected matter 201 or the resultant matter changed from the collected matter 201 into the gas 211 and the liquid 213, and the collected matter path P makes the separated gas 211 flow into a position between the high pressure turbine 101 and the reheater 109.

Here, the first embodiment and the fifth embodiment will be compared with each other.

In the first embodiment, the collected matter 201 itself is made to flow into a position between the high pressure turbine 101 and the reheater 109. For this reason, when the collected matter 201 contains moisture, the reheater 109 needs a heat input amount corresponding to latent heat for evaporating the moisture.

On the contrary, in the fifth embodiment, only the gas 211 is made to flow into a position between the high pressure turbine 101 and the reheater 109. For this reason, in the reheater 109 of the fifth embodiment, the heat input amount corresponding to the latent heat is not needed. Therefore, according to the fifth embodiment, the performance of the steam turbine cycle improves as much as the unnecessary heat input amount corresponding to the latent heat compared to the first embodiment.

Furthermore, in the fifth embodiment, the liquid 213 separated from the collected matter 201 is returned to the condenser 104 without being discarded, and is effectively used in the subsequent cycle.

As described above, according to the embodiment, when moisture is removed from the steam inside the high pressure turbine 101, it is possible to reduce deterioration in the output of the power generation and deterioration in the performance of the steam turbine cycle with the removal of the moisture. Furthermore, according to the embodiment, it is possible to improve the performance of the steam turbine cycle as much as the unnecessary heat input amount corresponding to the latent heat for evaporating the moisture compared to the first embodiment.

Sixth Embodiment

Figure 8:
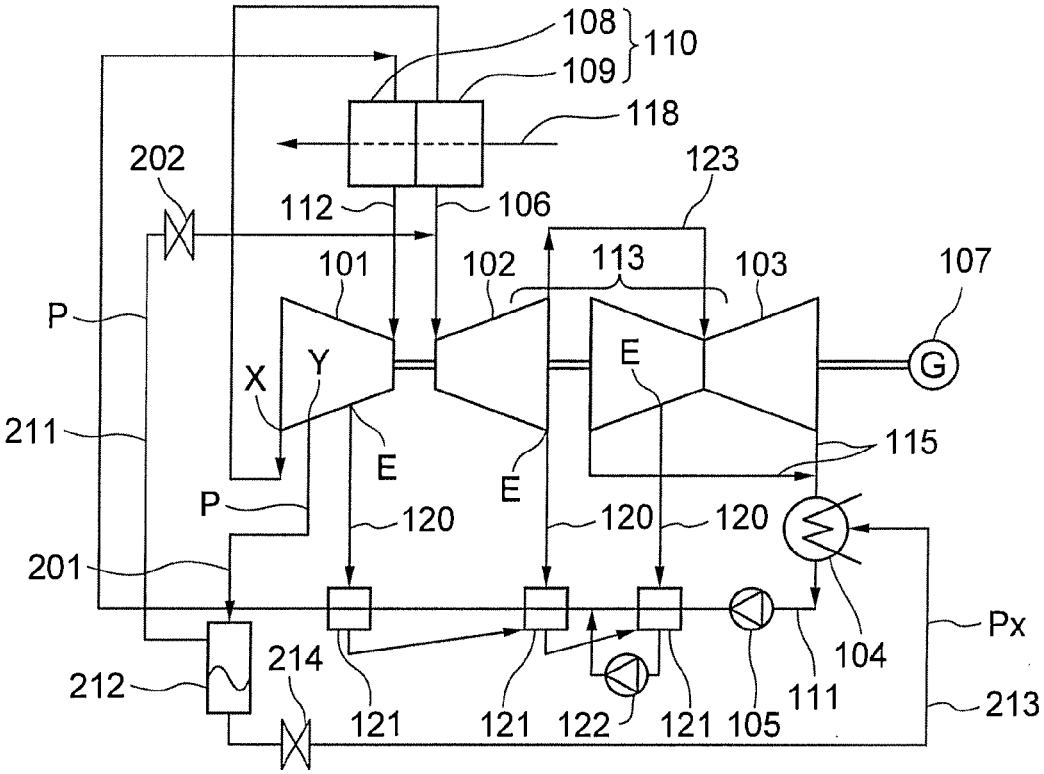
FIG. 8 is a schematic diagram illustrating a configuration of a steam turbine plant of a sixth embodiment.

FIG. 8 is a schematic diagram illustrating a configuration of the steam turbine plant of the sixth embodiment.

In the embodiment, the gas-liquid separator 212 separates the collected matter 201 or the resultant matter changed from the collected matter 201 into the gas 211 and the liquid 213, and the collected matter path P makes the separated gas 211 flow into the inlet of the reheat turbine 113, that is, the inlet of the intermediate pressure turbine 102 or the passage between the reheater 109 and the intermediate pressure turbine 102. Since the amount of inflow moisture is extremely small compared to the peripheral steam, the inflow moisture changes into steam by being heated by the peripheral steam, and is used as a part of the steam for driving the reheat turbine 113.

According to the embodiment, when moisture is removed from the steam inside the high pressure turbine 101, it is possible to reduce deterioration in the output of the power generation and deterioration in the performance of the steam turbine cycle with the removal of the moisture, as in the fifth embodiment. However, in the embodiment, there is an advantage in that it is easy to ensure a difference in the suction pressure compared to the fifth embodiment. Further, according to the embodiment, it is possible to improve the performance of the steam turbine cycle as much as the unnecessary heat input amount corresponding to the latent heat for evaporating the moisture compared to the second embodiment.

Seventh Embodiment

Figure 9:
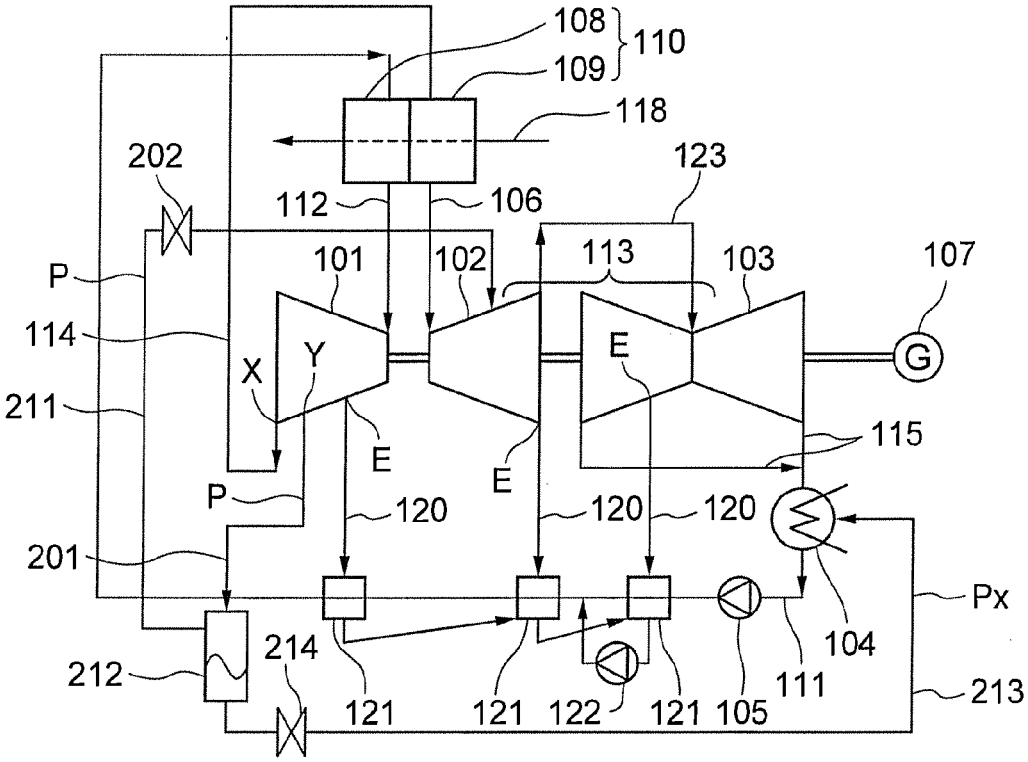
FIG. 9 is a schematic diagram illustrating a configuration of a steam turbine plant of a seventh embodiment.

FIG. 9 is a schematic diagram illustrating a configuration of the steam turbine plant of the seventh embodiment.

In the embodiment, the gas-liquid separator 212 changes the collected matter 201 or the resultant matter changed from the collected matter 201 into the gas 211 and the liquid 213, and the collected matter path P makes the separated gas 211 flow into the halfway stage of the reheat turbine 113, and more specifically, a position between the inlet of the intermediate pressure turbine 102 and the inlet of the final-stage rotor vane of the low pressure turbine 103 as the farthest downstream turbine. The inflow place of the collected matter 201 is not only the halfway stage of the intermediate pressure turbine 102 in FIG. 9, but may be a position between the intermediate pressure turbine 102 and the low pressure turbine 103 or the halfway stage of the low pressure turbine 103. Since the amount of inflow moisture is extremely small compared to the peripheral steam, the inflow moisture changes into steam by being heated by the peripheral steam, and is used as a part of the steam for driving the reheat turbine 113 at the downstream of the inflow place.

According to the embodiment, when moisture is removed from the steam inside the high pressure turbine 101, it is possible to reduce deterioration in the output of the power generation and deterioration in the performance of the steam turbine cycle with the removal of the moisture, as in the fifth and sixth embodiments. However, in the embodiment, there is an advantage in that it is easy to ensure a difference in the suction pressure compared to the fifth and sixth embodiments. Further, according to the embodiment, it is possible to improve the performance of the steam turbine cycle as much as the unnecessary heat input amount corresponding to the latent heat for evaporating the moisture compared to the third embodiment.

Eighth Embodiment

Figure 10:
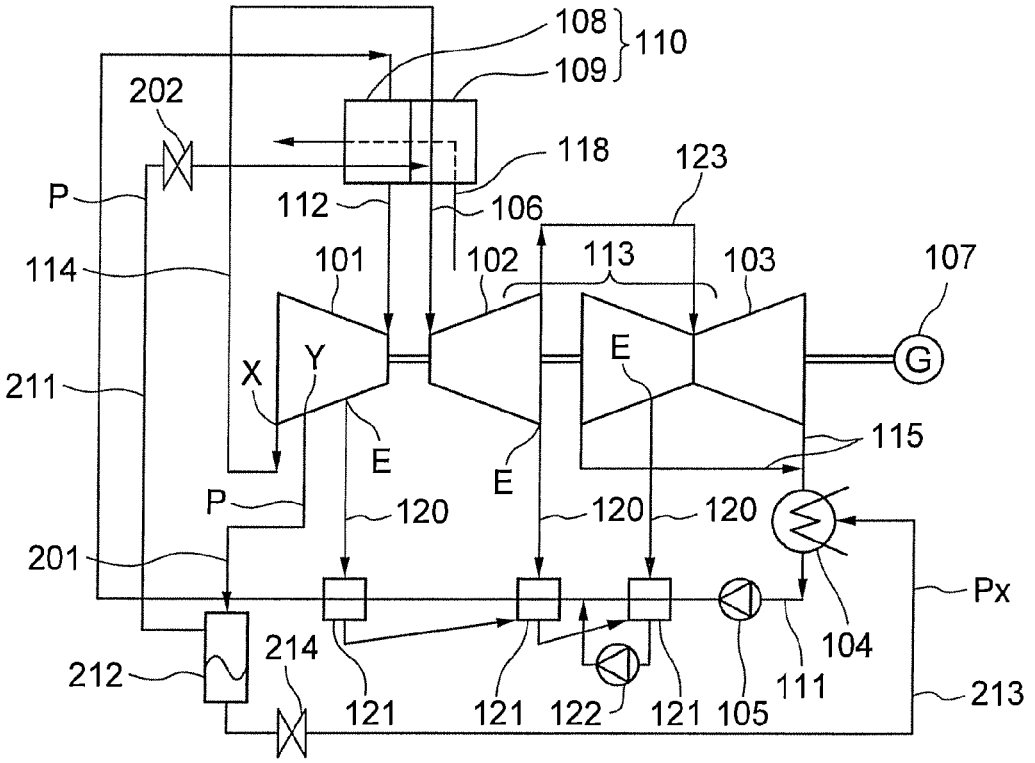
FIG. 10 is a schematic diagram illustrating a configuration of a steam turbine plant of an eighth embodiment.

FIG. 10 is a schematic diagram illustrating a configuration of the steam turbine plant of the eighth embodiment.

In the embodiment, the gas-liquid separator 212 separates the collected matter 201 or the resultant matter changed from the collected matter 201 into the gas 211 and the liquid 213, and the collected matter path P makes the separated gas 211 flow into the reheater 109.

In the embodiment, the separated gas 211 is made to flow into not the steam completely heated as the intermediate pressure turbine inlet steam 106, but the steam which is not completely heated as the intermediate pressure turbine inlet steam 106 inside the reheater 109. Therefore, in the embodiment, it is possible to adjust the temperature of the intermediate pressure turbine inlet steam 106 by adjusting the flow rate or the like of the heat medium 118 as in the fourth embodiment.

Further, in the embodiment, since the steam at the inflow place of the gas 211 inside the reheater 109 decreases in the pressure as much as the pressure loss from the outflow place of the collected matter 201 to the inflow place of the gas 211, it is easy to ensure a difference in the suction pressure compared to the fifth embodiment.

In this manner, in the embodiment, there is an advantage in that it is easy to ensure a difference in the suction pressure which easily adjusts the temperature of the intermediate pressure turbine inlet steam 106.

According to the embodiment, when moisture is removed from the steam inside the high pressure turbine 101, it is possible to reduce deterioration in the output of the power generation and deterioration in the performance of the steam turbine cycle with the removal of the moisture, as in the fifth to seventh embodiments. Further, according to the embodiment, it is possible to improve the performance of the steam turbine cycle as much as the unnecessary heat input amount corresponding to the latent heat for evaporating the moisture compared to the fourth embodiment.

Ninth Embodiment

Figure 11:
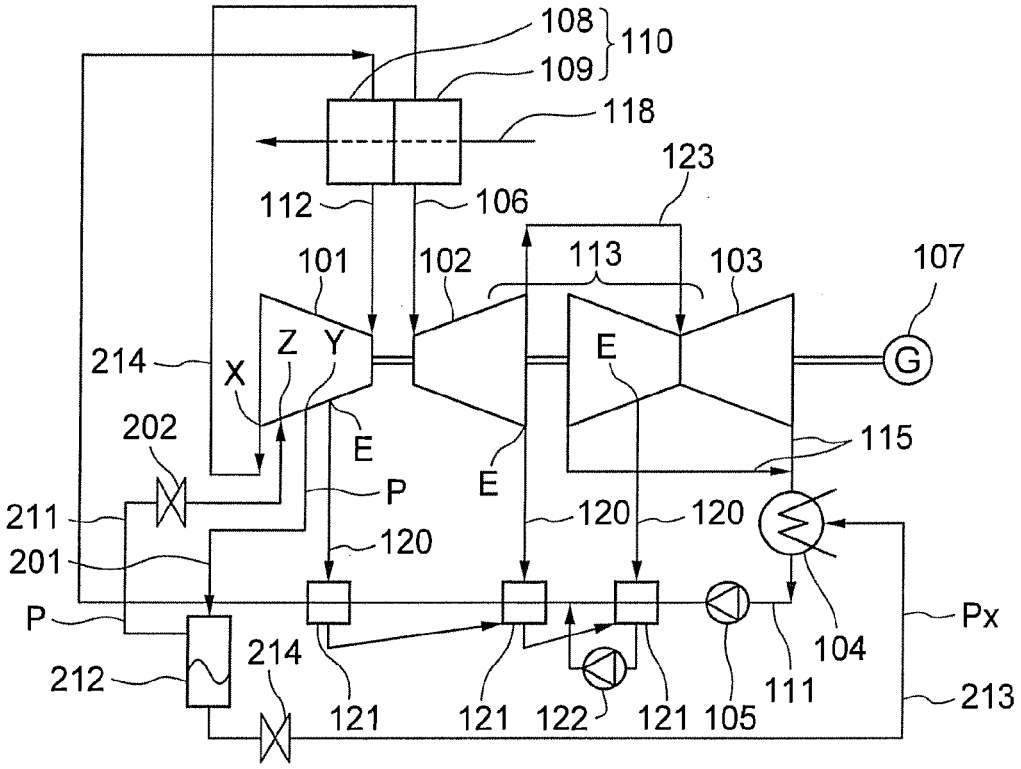
FIG. 11 is a schematic diagram illustrating a configuration of a steam turbine plant of a ninth embodiment.

FIG. 11 is a schematic diagram illustrating a configuration of the steam turbine plant of the ninth embodiment.

In the embodiment, the gas-liquid separator 212 separates the collected matter 201 or the resultant matter changed from the collected matter 201 into the gas 211 and the liquid 213, and the collected matter path P makes the separated gas 211 flow into the steam between the collection place of the collected matter 201 inside the high pressure turbine 101 and the inlet of the final-stage rotor vane. In FIG. 11, the collection place (the outflow place) of the collected matter 201 is denoted by the reference character Y, and the inflow place of the collected matter 201 is denoted by the reference character Z.

In FIG. 11, there is a need to pay attention that the inflow place Z of the collected matter 201 is located at the downstream of the collection place Y. In the embodiment, the inflow place Z of the collected matter 201 is installed at the downstream place of the closest rotor vane 301 located at the downstream of the collection place Y.

When the collector is the slit attached stator vane 312, the inflow place Z is installed at the downstream of the rotor vane 301 located right behind the slit attached stator vane 312. In this case, the inflow place Z is installed at a place where a difference in the suction pressure, that is, a difference in the pressure between the vicinity of the slit 307 and the inflow place Z is set to an appropriate value. When a difference in the pressure is large, the pressure difference is adjusted on the basis of the opening degree of the valve 202. When the collector is the slit attached stator vane 312, the enthalpy of the accompanying steam is utilized without being directly discarded to the condenser 104, and is used as a part of the output of the power generation.

When the collector is the drain catcher 304 or the groove attached rotor vane 311 and the drain catcher 304, the inflow place Z is installed at the downstream of the rotor vane 301 right behind the drain catcher 304. Accordingly, there is an advantage in that the flow rate of the steam right behind the inflow place Z less decreases.

In this manner, according to the embodiment, it is possible to reduce deterioration in the output of the power generation and deterioration in the performance of the steam turbine cycle with the removal of the moisture.

Furthermore, in the embodiment, when humid steam is present inside the intermediate pressure turbine 102, the collection place Y of the collected matter 201 and the inflow place Z may be installed at the intermediate pressure turbine 102. In the same manner, when the humid steam is present inside the low pressure turbine 103, the collection place Y of the collected matter 201 and the inflow place Z may be installed at the low pressure turbine 103. In this manner, the embodiment may be applied to the reheat turbine 113 as in the high pressure turbine 101.

As described above, according to the embodiment, when moisture is removed from the steam inside the steam turbine, it is possible to reduce deterioration in the output of the power generation and deterioration in the performance of the steam turbine cycle with the removal of the moisture. Furthermore, according to the embodiment, it is possible to improve the performance of the steam turbine cycle as much as the unnecessary heat input amount corresponding to the latent heat for evaporating the moisture compared to the first to fourth embodiments.

Tenth Embodiment

Figure 12:
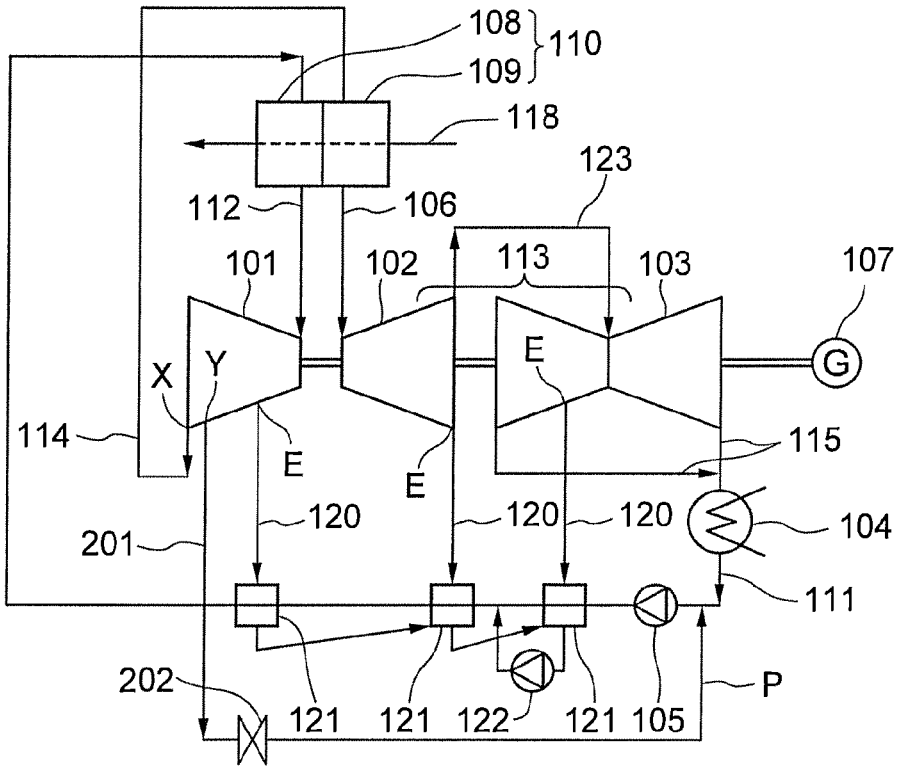
FIG. 12 is a schematic diagram illustrating a configuration of a steam turbine plant of a tenth embodiment.

FIG. 12 is a schematic diagram illustrating a configuration of the steam turbine plant of the tenth embodiment.

The collected matter path P of the embodiment makes the collected matter 201 flow into feed-water 111 between the condenser 104 and the boiler 108. However, since it is desirable that the inflow place have a pressure lower than that of the outflow place Y in order to make the collected matter 201 easily flow into the inflow place, the collected matter path P of the embodiment makes the collected matter 201 flow into a position between the condenser 104 and a condensed water pump 105.

Since the amount of the collected matter 201 is smaller than that of the feed-water 111, the collected matter 201 is added into the feed-water 111. If the collected matter 201 is discarded to the condenser 104, since the collected matter 201 is cooled by the cooing water, latent heat and sensible heat of the accompanying steam contained in the collected matter 201 or sensible heat of the water contained in the collected matter 201 are wasted. However, in the embodiment, since the collected matter 201 is made to flow into the feed-water 111, the heat input amount of the boiler 108 decreases as much as latent heat and sensible heat of the collected matter 201 are not wasted, and deterioration in the performance of the steam turbine cycle is reduced.

Furthermore, in the embodiment, when humid steam is present inside the intermediate pressure turbine 102 or the low pressure turbine 103, the collection place Y of the collected matter 201 may be installed at the intermediate pressure turbine 102 or the low pressure turbine 103.

As described above, according to the embodiment, when moisture is removed from the steam inside the steam turbine, it is possible to reduce deterioration in the output of the power generation and deterioration in the performance of the steam turbine cycle with the removal of the moisture. Specifically, according to the embodiment, the performance of the steam turbine cycle may improve as much as latent heat and sensible heat of the collected matter 201 are not wasted.

Eleventh Embodiment

Figure 13:
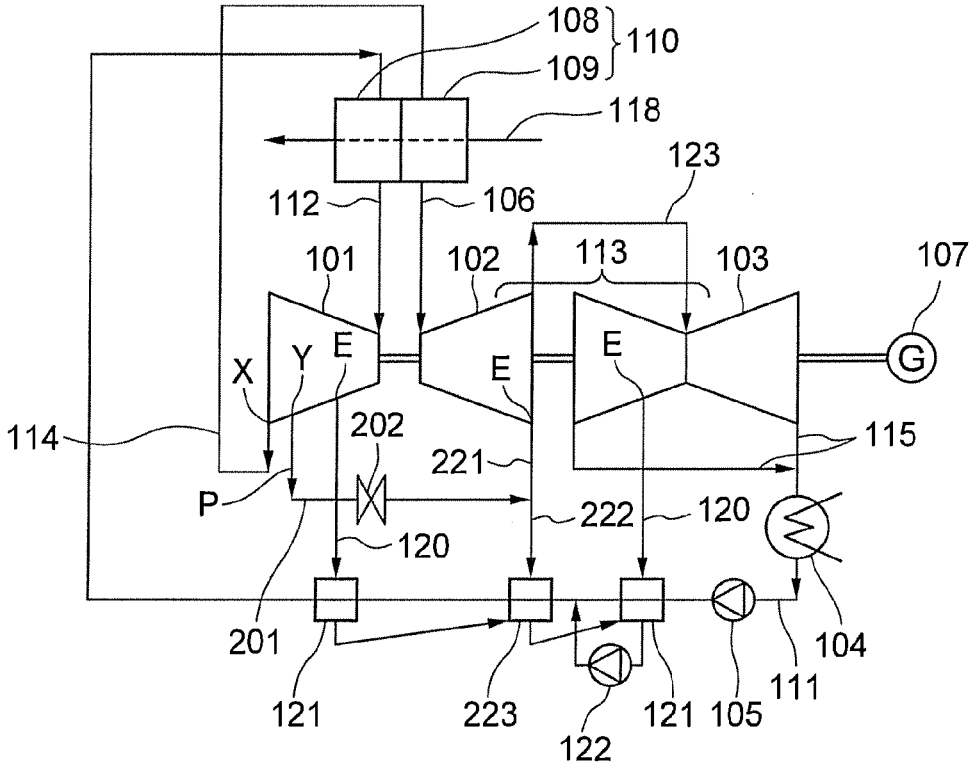
FIG. 13 is a schematic diagram illustrating a configuration of a steam turbine plant of an eleventh embodiment.

FIG. 13 is a schematic diagram illustrating a configuration of the steam turbine plant of the eleventh embodiment.

The collected matter path P of the embodiment makes the collected matter 201 flow into a feed-water heater 223 for heating the feed-water 111 from the condenser 104 or a position between the extraction port E of the reheat turbine 113 and the feed-water heater 223, and the collected matter is used as a heat medium heating the feed-water 111 in the feed-water heater 223. In FIG. 13, the collected matter 201 is made to flow into a position between the extraction port E of the intermediate pressure turbine 102 and the feed-water heater 223. In FIG. 13, the feed-water heater into which the collected matter 201 flows and the other feed-water heater are classified by the reference numeral 223 and the reference numeral 121.

In FIG. 13, the extraction steam from the extraction port E of the intermediate pressure turbine 102 is denoted by the reference numeral 221. The collected matter path P of the embodiment makes the collected matter 201 merge with an extraction passage through which the extraction steam 221 flows. In FIG. 13, the extraction steam merging with the collected matter 201 is denoted by the reference numeral 222. The extraction steam 222 flows into the feed-water heater 223, is used as the heat source of the feed-water 111, and merges with the feed-water 111 after heating the feed-water 111. Furthermore, in the embodiment, the extraction port E of the intermediate pressure turbine 102 is installed around the outlet of the intermediate pressure turbine 102.

In this manner, in the embodiment, the collected matter 201 is merged with the extraction steam 221 without being discarded to the condenser 104. If the collected matter 201 is discarded to the condenser 104, since the collected matter 201 is cooled by the cooling water, latent heat and sensible heat of the collected matter 201 are wasted. However, in the embodiment, since the collected matter 201 merges with the extraction steam 221, the heat input amount of the boiler 108 decreases as much as the latent heat and the sensible heat of the collected matter 201 are not wasted, and deterioration in the performance of the steam turbine cycle is reduced.

Further, in the embodiment, since the steam turbine cycle is similar to the Carnot cycle compared to the tenth embodiment in which the collected matter 201 is directly merged with the feed-water 111, the performance of the steam turbine cycle improves.

Furthermore, in the embodiment, when humid steam is present inside the intermediate pressure turbine 102 or the low pressure turbine 103, the collection place Y of the collected matter 201 may be installed at the intermediate pressure turbine 102 or the low pressure turbine 103.

As described above, according to the embodiment, when moisture is removed from the steam inside the steam turbine, the performance of the steam turbine cycle may improve as much as the latent heat and the sensible heat of the collected matter 201 are not wasted, as in the tenth embodiment.

Furthermore, the feed-water heater 223 of the embodiment also includes a deaerator which deaerates the feed-water 111 with the inflow of the extraction steam 222. The same applies to the embodiments to be described below.

Twelfth Embodiment

Figure 14:
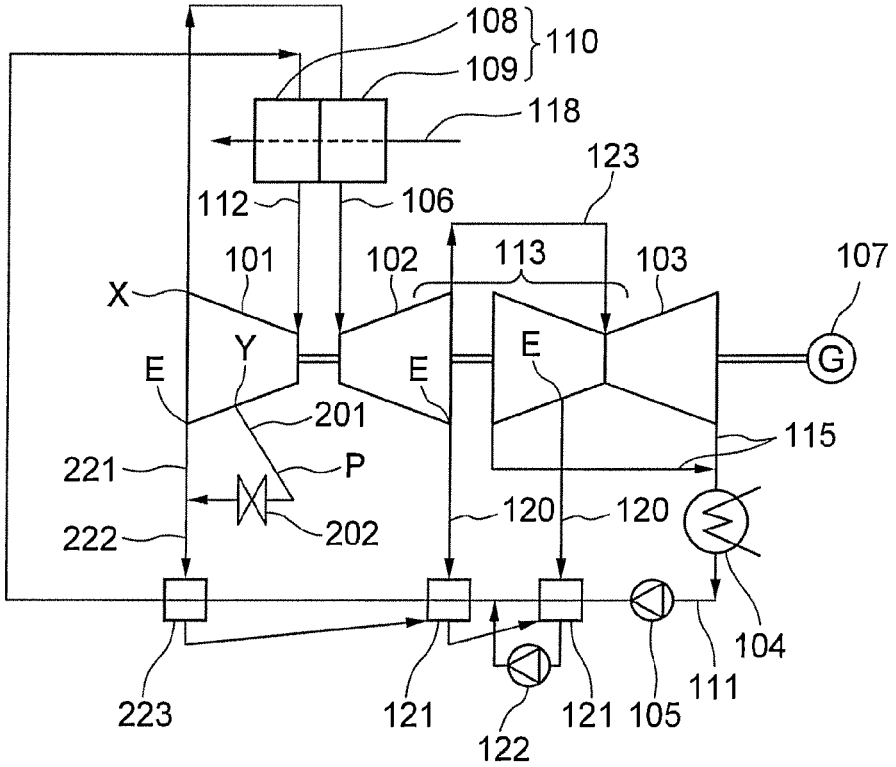
FIG. 14 is a schematic diagram illustrating a configuration of a steam turbine plant of a twelfth embodiment.

FIG. 14 is a schematic diagram illustrating a configuration of the steam turbine plant of the twelfth embodiment.

The collected matter path P of the embodiment makes the collected matter 201 flow into a position between the extraction port E of the high pressure turbine 101 and the feed-water heater 223 or into the feed-water heater 223, and the collected matter is used as a heat medium heating the feed-water 111 in the feed-water heater 223. However, the extraction port E is set to a place which is located at the downstream of the collection place Y and has a lower pressure. In FIG. 14, the feed-water heater into which the collected matter 201 flows and the other feed-water heater are classified by the reference numeral 223 and the reference numeral 121 as in FIG. 13.

In FIG. 14, the extraction steam from the extraction port E of the high pressure turbine 101 is denoted by the reference numeral 221. The collected matter path P of the embodiment makes the collected matter 201 merge with an extraction passage through which the extraction steam 221 flows. In FIG. 14, the extraction steam merging with the collected matter 201 is denoted by the reference numeral 222. The extraction steam 222 flows into the feed-water heater 223, is used as the heat source of the feed-water 111, and merges with the feed-water 111 after heating the feed-water 111. Furthermore, in the embodiment, the extraction port E of the high pressure turbine 101 is installed around the outlet of the high pressure turbine 101.

In this manner, in the embodiment, the collected matter 201 is merged with the extraction steam 221 without being discarded to the condenser 104. If the collected matter 201 is discarded to the condenser 104, since the collected matter 201 is cooled by the cooling water, latent heat and sensible heat of the collected matter 201 are wasted. However, in the embodiment, since the collected matter 201 merges with the extraction steam 221, the heat input amount of the boiler 108 decreases as much as the latent heat and the sensible heat of the collected matter 201 are not wasted, and deterioration in the performance of the steam turbine cycle is reduced.

Further, in the embodiment, since the steam turbine cycle is similar to the Carnot cycle compared to the tenth embodiment in which the collected matter 201 is directly merged with the feed-water 111, the performance of the steam turbine cycle improves.

Further, in the embodiment, since the collected matter 201 and the extraction steam 221 all flow from the high pressure turbine 101, the temperature of the collected matter 201 and the temperature of the extraction steam 221 are almost equal to each other. Therefore, according to the embodiment, the performance of the steam turbine cycle improves compared to the eleventh embodiment.

Furthermore, in the embodiment, when humid steam is present inside the intermediate pressure turbine 102 or the low pressure turbine 103, the collection place Y of the collected matter 201 and the extraction place of the extraction steam 211 may be installed at the intermediate pressure turbine 102 or the low pressure turbine 103.

As described above, according to the embodiment, when moisture is removed from the steam inside the steam turbine, the performance of the steam turbine cycle may improve as much as the latent heat and the sensible heat of the collected matter 201 are not wasted, as in the tenth and eleventh embodiments.

Thirteenth Embodiment

Figure 15:
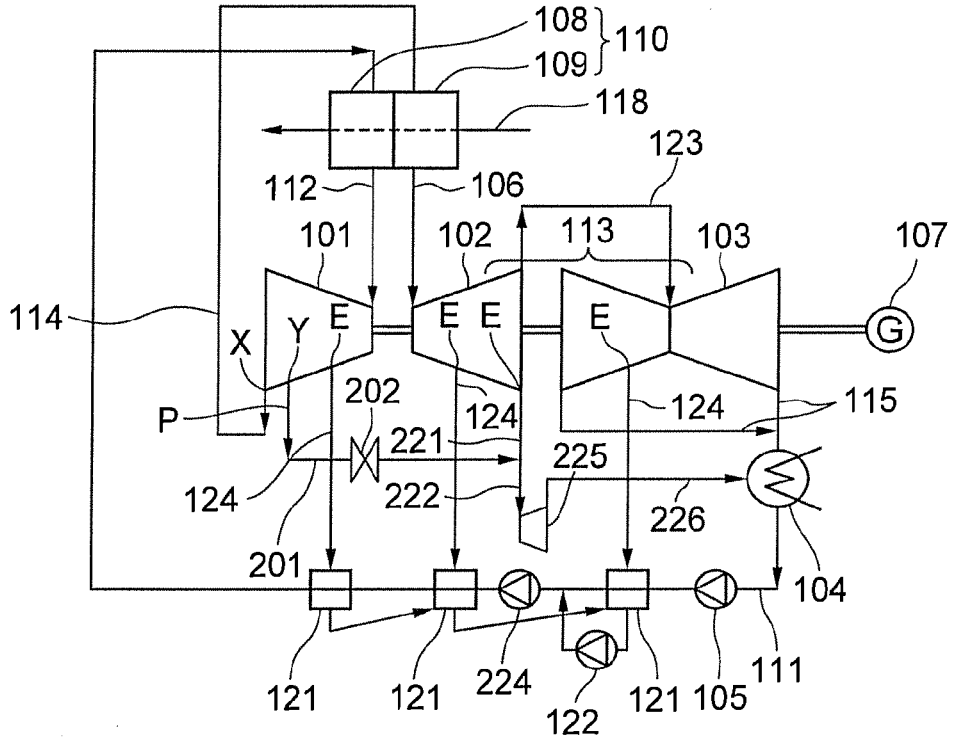
FIG. 15 is a schematic diagram illustrating a configuration of a steam turbine plant of a thirteenth embodiment.

FIG. 15 is a schematic diagram illustrating a configuration of the steam turbine plant of the thirteenth embodiment.

In FIG. 15, a feed-water pump 224 is disposed on the passage between the condenser 104 and the boiler 108 to transfer the feed-water 111. Furthermore, in FIG. 15, a feed-water pump driving steam turbine 225 is disposed on the passage between the extraction port E of the high pressure turbine 101 or the reheat turbine 113 and the condenser 104 to drive the feed-water pump 224. However, the extraction port E is set to a place which is located at the downstream of the collection place Y and has a lower pressure. More specifically, the feed-water pump driving steam turbine 225 of FIG. 15 is disposed between the extraction port E provided around the outlet of the intermediate pressure turbine 102 and the condenser 104. The collected matter path P of the embodiment makes the collected matter 201 flow into the feed-water pump driving steam turbine 225 or the extraction passage to the feed-water pump driving steam turbine 225.

In FIG. 15, the extraction steam from the extraction port E of the intermediate pressure turbine 102 is denoted by the reference numeral 221. The collected matter path P of the embodiment makes the collected matter 201 merge with the extraction passage through which the extraction steam 221 flows. In FIG. 15, the extraction steam merging with the collected matter 201 is denoted by the reference numeral 222. The extraction steam 222 flows into the feed-water pump driving steam turbine 225 and circulates while decreasing in both the pressure and the temperature, so that it drives the feed-water pump driving steam turbine 225.

Feed-water pump driving steam turbine exhaust 226 sufficiently decreases in both the pressure and the temperature, and flows into the condenser 104. The feed-water pump 224 is driven by power obtained from the feed-water pump driving steam turbine 225.

Since the amount of the collected matter 201 merging with the extraction steam 221 is extremely small compared to the peripheral steam, the collected water changes into steam by being heated by the peripheral steam, and is used as a part of the steam for driving the feed-water pump driving steam turbine 225.

If the collected matter 201 is discarded to the condenser 104, since the collected matter 201 is cooled by the cooling water, enthalpy of the collected matter 201 is wasted. However, in the embodiment, since the collected matter 201 merges with the extraction steam 221, the heat input amount of the boiler 108 decreases as much as the enthalpy of the collected matter 201 is not wasted, and deterioration in the performance of the steam turbine cycle is reduced.

Further, in the embodiment, since the collected matter 201 is used in the feed-water pump driving steam turbine 225, it is possible to decrease the amount of the extraction steam. Therefore, according to the embodiment, the flow rate of the turbine steam at the downstream of the extraction place of the extraction steam 221 decreases, and the output of the power generation and the performance of the steam turbine cycle improve.

As described above, according to the embodiment, when moisture is removed from the steam inside the steam turbine, the performance of the steam turbine cycle may improve as much as the enthalpy of the collected matter 201 is not wasted.

Fourteenth Embodiment

Figure 16:
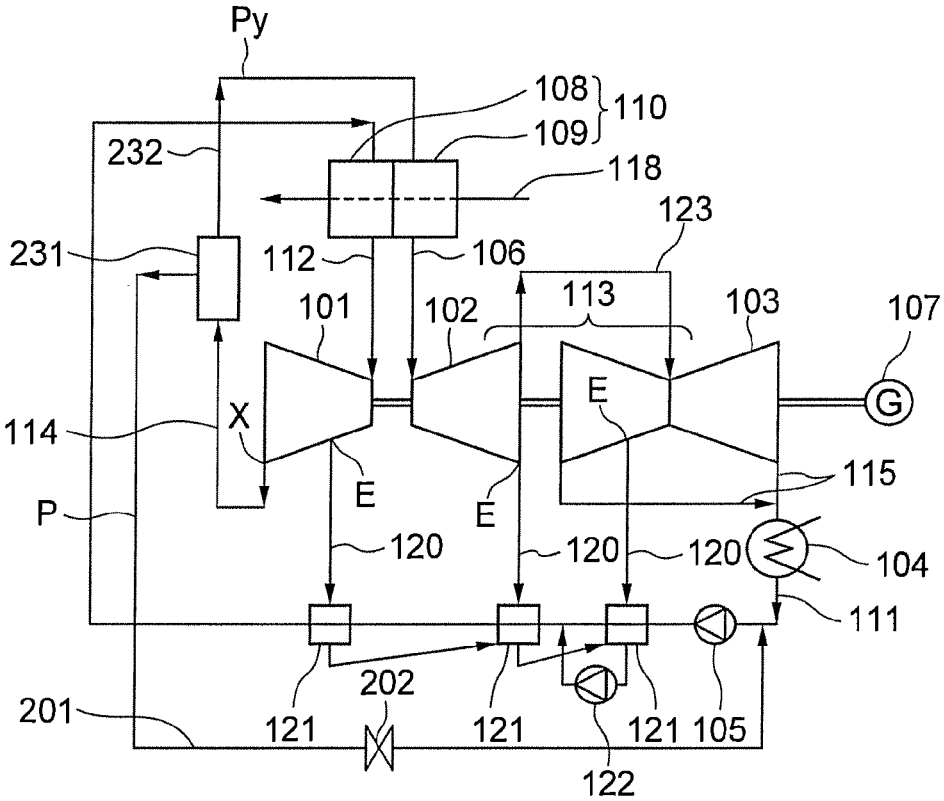
FIG. 16 is a schematic diagram illustrating a configuration of a steam turbine plant of a fourteen embodiment.

FIG. 16 is a schematic diagram illustrating a configuration of the steam turbine plant of the fourteenth embodiment.

The collector of the embodiment is a moisture separator 231 which separates moisture from the high pressure turbine exhaust 114 and collects the separated moisture as the collected matter 201. In the embodiment, the high pressure turbine exhaust 114 is humid steam, and flows into the moisture separator 231. The moisture, that is, the collected matter 201 separated from the high pressure turbine exhaust 114 by the moisture separator 231 is exhausted to the collected matter path P. The moisture separator 231 used in the embodiment may be of any operation type.

In the embodiment, when the humidity of the high pressure turbine exhaust 114 is very high, it is possible to remove most of moisture (the collected matter 201) from the exhaust 114 using the moisture separator 231 without making the entire amount of the high pressure turbine exhaust 114 flow into the reheater 109. In this case, the remaining steam 232 subjected to the removal of the moisture is made to flow into the reheater 109 and flow into the intermediate pressure turbine 102. In FIG. 16, a separation steam path $P_Y$ making the steam 232 subjected to the removal of the moisture flow into the reheater 109 is denoted by $P_Y$.

In the embodiment, the collected matter 201 from the moisture separator 231 is moisture or moisture and steam. The collected matter path P of the embodiment makes the collected matter 201 flow into the feed-water 111 between the condenser 104 and the boiler 108. However, since there is a need that the inflow place has a pressure lower than that around the moisture separator 231 in order to make the collected matter 201 easily flow into the inflow place, the collected matter path P of the embodiment makes the collected matter 201 flow into a position between the condenser 104 and the condensed water pump 105.

If the collected matter 201 is discarded to the condenser 104, since the collected matter 201 is cooled by the cooling water, latent heat and sensible heat of the accompanying steam contained in the collected matter 201 or sensible heat of the water contained in the collected matter 201 are wasted. However, in the embodiment, since the collected matter 201 is made to flow into the feed-water 111, the heat input amount of the boiler 108 decreases as much as latent heat and sensible heat of the collected matter 201 are not wasted, and deterioration in the performance of the steam turbine cycle is reduced.

As described above, according to the embodiment, when moisture is removed from the exhaust of the high pressure turbine 101, it is possible to reduce deterioration in the output of the power generation and deterioration in the performance of the steam turbine cycle with the removal of the moisture. Specifically, according to the embodiment, the performance of the steam turbine cycle may improve as much as latent heat and sensible heat of the collected matter 201 are not wasted.

Fifteenth Embodiment

Figure 17:
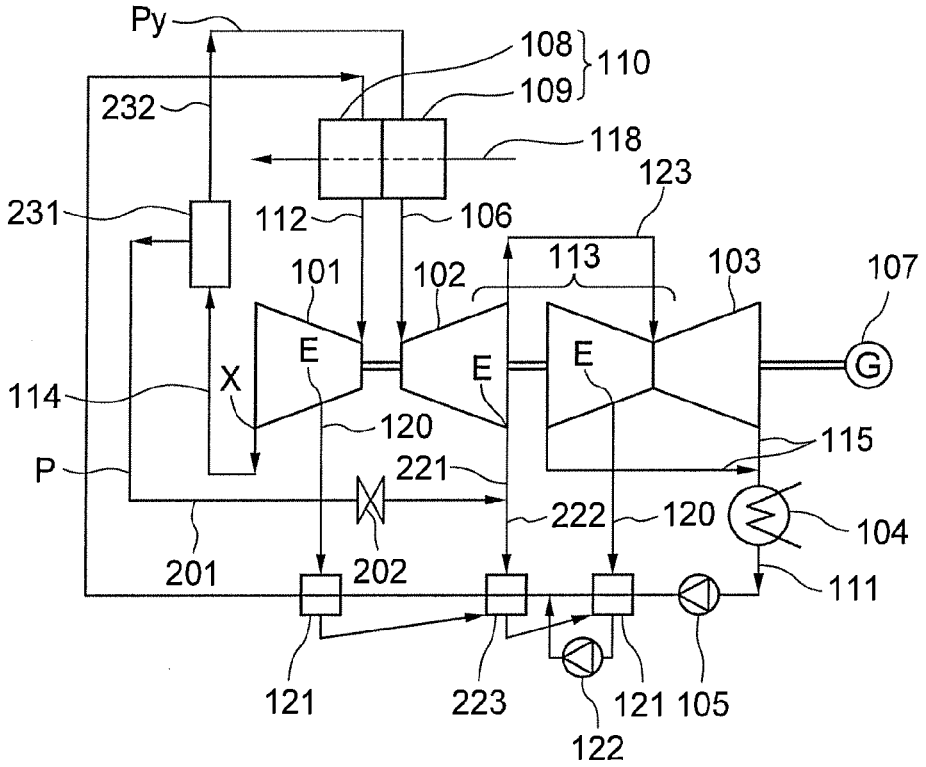
FIG. 17 is a schematic diagram illustrating a configuration of a steam turbine plant of a fifteen embodiment.

FIG. 17 is a schematic diagram illustrating a configuration of the steam turbine plant of the fifteenth embodiment.

The collector of the embodiment is the moisture separator 231 which separates moisture from the high pressure turbine exhaust 114 and collects at least the separated moisture as the collected matter 201 as in the fourteenth embodiment. In the embodiment, the high pressure turbine exhaust 114 is humid steam, and flows into the moisture separator 231.

The collected matter path P of the embodiment makes the collected matter 201 flow into a position between the extraction port E of the reheat turbine 113 and the feed-water heater 223 or into the feed-water heater 223. In FIG. 17, the collected matter 201 is made to flow into a position between the extraction port E of the intermediate pressure turbine 102 and the feed-water heater 223. In FIG. 17, the feed-water heater into which the collected matter 201 flows and the other feed-water heater are classified by the reference numeral 223 and the reference numeral 121.

In FIG. 17, the extraction steam from the extraction port E of the intermediate pressure turbine 102 is denoted by the reference numeral 221. The collected matter path P of the embodiment makes the collected matter 201 flow into an extraction passage through which the extraction steam 221 flows. In FIG. 17, the extraction steam merging with the collected matter 201 is denoted by the reference numeral 222. The extraction steam 222 flows into the feed-water heater 223, is used as the heat source of the feed-water 111, and merges with the feed-water 111 after heating the feed-water 111. Furthermore, in the embodiment, the extraction port E of the intermediate pressure turbine 102 is installed around the outlet of the intermediate pressure turbine 102.

If the collected matter 201 is discarded to the condenser 104, since the collected matter 201 is cooled by the cooling water, latent heat and sensible heat of the collected matter 201 are wasted. However, in the embodiment, since the collected matter 201 is made to flow into the extraction steam 221, the heat input amount of the boiler 108 decreases as much as the latent heat and the sensible heat of the collected matter 201 are not wasted, and deterioration in the performance of the steam turbine cycle is reduced.

Further, in the embodiment, since the steam turbine cycle is similar to the Carnot cycle compared to the fourteenth embodiment in which the collected matter 201 is directly merged with the feed-water 111, the performance of the steam turbine cycle improves.

As described above, according to the embodiment, when moisture is removed from the exhaust of the high pressure turbine 101, the performance of the steam turbine cycle may improve as much as the latent heat and the sensible heat of the collected matter 201 are not wasted, as in the fourteenth embodiment.

Sixteenth Embodiment

Figure 18:
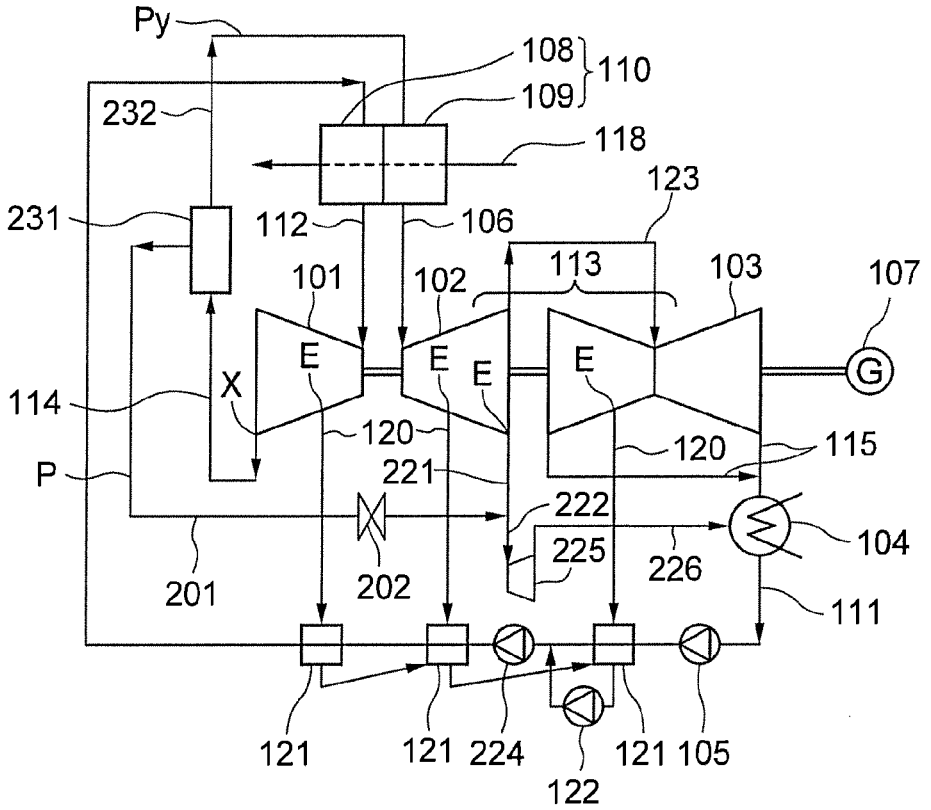
FIG. 18 is a schematic diagram illustrating a configuration of a steam turbine plant of a sixteen embodiment.

FIG. 18 is a schematic diagram illustrating a configuration of the steam turbine plant of the sixteenth embodiment.

The collector of the embodiment is the moisture separator 231 which separates moisture from the high pressure turbine exhaust 114 and collects at least the separated moisture as the collected matter 201 as in the fourteenth and fifteenth embodiments. In the embodiment, the high pressure turbine exhaust 114 is humid steam, and flows into the moisture separator 231.

In FIG. 18, the feed-water pump 224 is disposed on the passage between the condenser 104 and the boiler 108 to transfer the feed-water 111. Furthermore, in FIG. 18, the feed-water pump driving steam turbine 225 is disposed on the passage between the extraction port E of the reheat turbine 113 and the condenser 104 to drive the feed-water pump 224. More specifically, the feed-water pump driving steam turbine 225 of FIG. 18 is disposed between the extraction port E installed around the outlet of the intermediate pressure turbine 102 and the condenser 104. The collected matter path P of the embodiment makes the collected matter 201 flow into the feed-water pump driving steam turbine 225 or the extraction passage to the feed-water pump driving steam turbine 225.

In FIG. 18, the extraction steam from the extraction port E of the intermediate pressure turbine 102 is denoted by the reference numeral 221. The collected matter path P of the embodiment makes the collected matter 201 flow into an extraction passage through which the extraction steam 221 flows. In FIG. 18, the extraction steam merging with the collected matter 201 is denoted by the reference numeral 222. The extraction steam 222 flows into the feed-water pump driving steam turbine 225 and circulates while decreasing in both the pressure and the temperature, so that it drives the feed-water pump driving steam turbine 225.

The feed-water pump driving steam turbine exhaust 226 sufficiently decreases in both the pressure and the temperature, and flows into the condenser 104. The feed-water pump 224 is driven by power obtained from the feed-water pump driving steam turbine 225.

Since the amount of the collected matter 201 merging with the extraction steam 221 is extremely small compared to the peripheral steam, the collected water changes into steam by being heated by the peripheral steam, and is used as a part of the steam for driving the feed-water pump driving steam turbine 225.

If the collected matter 201 is discarded to the condenser 104, since the collected matter 201 is cooled by the cooling water, enthalpy of the collected matter 201 is wasted. However, in the embodiment, since the collected matter 201 merges with the extraction steam 221, the heat input amount of the boiler 108 decreases as much as the enthalpy of the collected matter 201 is not wasted, and deterioration in the performance of the steam turbine cycle is reduced.

Further, in the embodiment, since the collected matter 201 is used in the feed-water pump driving steam turbine 225, it is possible to decrease the amount of the extraction steam. Therefore, according to the embodiment, the flow rate of the turbine steam at the downstream of the extraction place of the extraction steam 221 decreases, and the output of the power generation and the performance of the steam turbine cycle improve.

As described above, according to the embodiment, when moisture is removed from the exhaust of the high pressure turbine 101, the performance of the steam turbine cycle may improve as much as the enthalpy of the collected matter 201 is not wasted.

Seventeenth Embodiment

Figure 19:
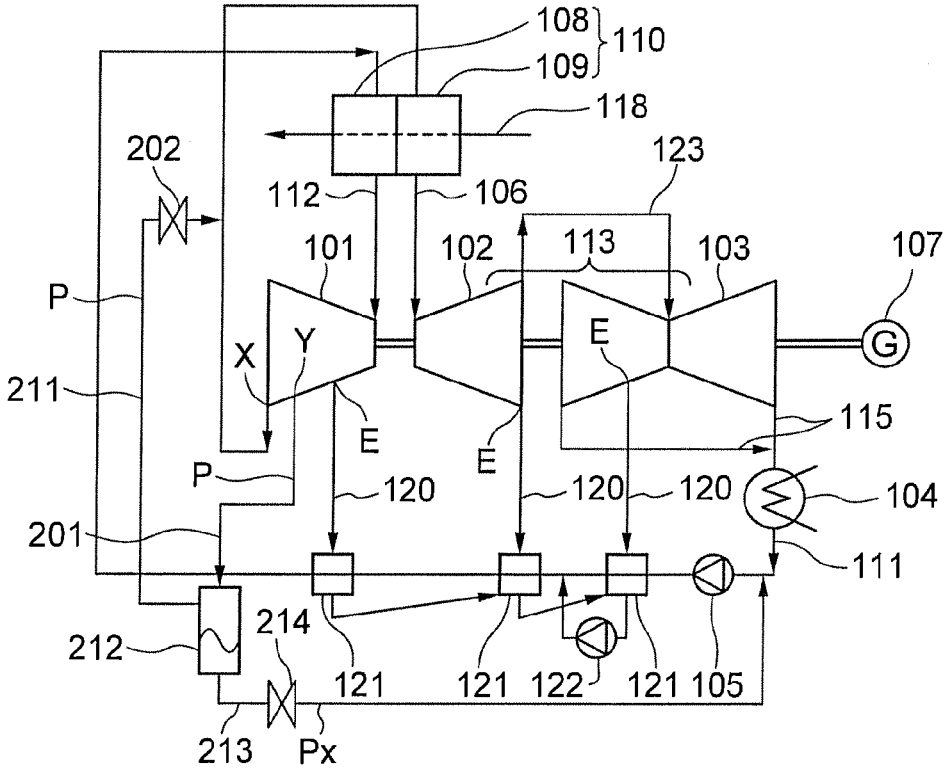
FIG. 19 is a schematic diagram illustrating a configuration of a steam turbine plant of a seventeen embodiment.

FIG. 19 is a schematic diagram illustrating a configuration of the steam turbine plant of the seventeenth embodiment.

In the fifth embodiment (FIG. 7), the liquid 213 is made to flow into the condenser 104 by the separated liquid path Px. On the contrary, in the seventeenth embodiment (FIG. 19), the liquid 213 is made to flow into a position between the condenser 104 and the condensed water pump 105 by the separated liquid path Px.

As in FIG. 7, when the liquid 213 is discarded to the condenser 104, sensible heat contained in the liquid 213 is wasted. However, in FIG. 19, since the liquid 213 is made to flow into the feed-water 111, the heat input amount of the boiler 108 decreases as much as sensible heat of the liquid 213 is not wasted, and deterioration in the performance of the steam turbine cycle is reduced.

As described above, according to the embodiment, when moisture is removed from the steam which exists upstream of the inlet of the final-stage rotor vane in the high pressure turbine 101, it is possible to reduce deterioration in the output of the power generation and deterioration in the performance of the steam turbine cycle with the removal of the moisture. Specifically, according to the embodiment, the performance of the steam turbine cycle may improve as much as sensible heat of the liquid 213 is not wasted.

Eighteenth Embodiment

Figure 20:
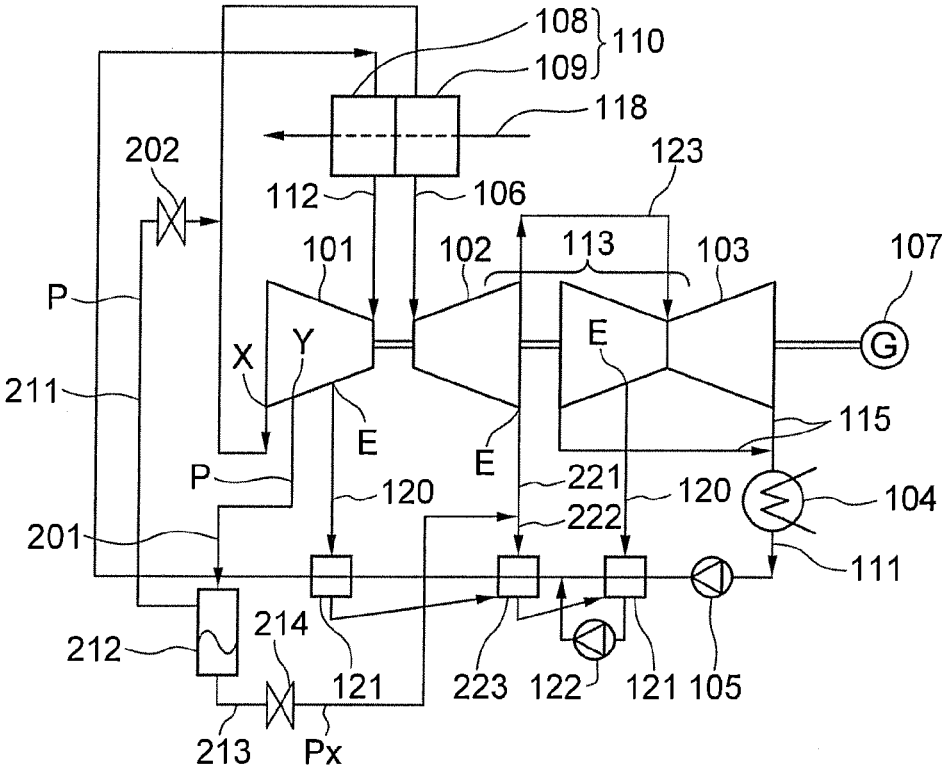
FIG. 20 is a schematic diagram illustrating a configuration of a steam turbine plant of an eighteen embodiment.

FIG. 20 is a schematic diagram illustrating a configuration of the steam turbine plant of the eighteenth embodiment.

In the fifth embodiment (FIG. 7), the liquid 213 is made to flow into the condenser 104 by the separated liquid path Px. On the contrary, in the eighteenth embodiment (FIG. 20), the liquid 213 is made to flow into the extraction steam 221 between the extraction port E of the high pressure turbine 101 or the reheat turbine 113 and the feed-water heater 223 or into the feed-water heater 223 by the separated liquid path Px.

As in FIG. 7, when the liquid 213 is discarded to the condenser 104, sensible heat contained in the liquid 213 is wasted. However, in FIG. 20, since the liquid 213 is made to flow into the extraction steam 221, the heat input amount of the boiler 108 decreases as much as sensible heat of the liquid 213 is not wasted, and deterioration in the performance of the steam turbine cycle is reduced.

Further, in the embodiment, since the steam turbine cycle is similar to the Carnot cycle compared to the seventeenth embodiment in which the liquid 213 is directly merged with the feed-water 111, the performance of the steam turbine cycle improves.

As described above, according to the embodiment, when moisture is removed from the exhaust of the high pressure turbine 101, it is possible to reduce deterioration in the output of the power generation and deterioration in the performance of the steam turbine cycle with the removal of the moisture, as in the seventeenth embodiment.

Nineteenth Embodiment

Figure 21:
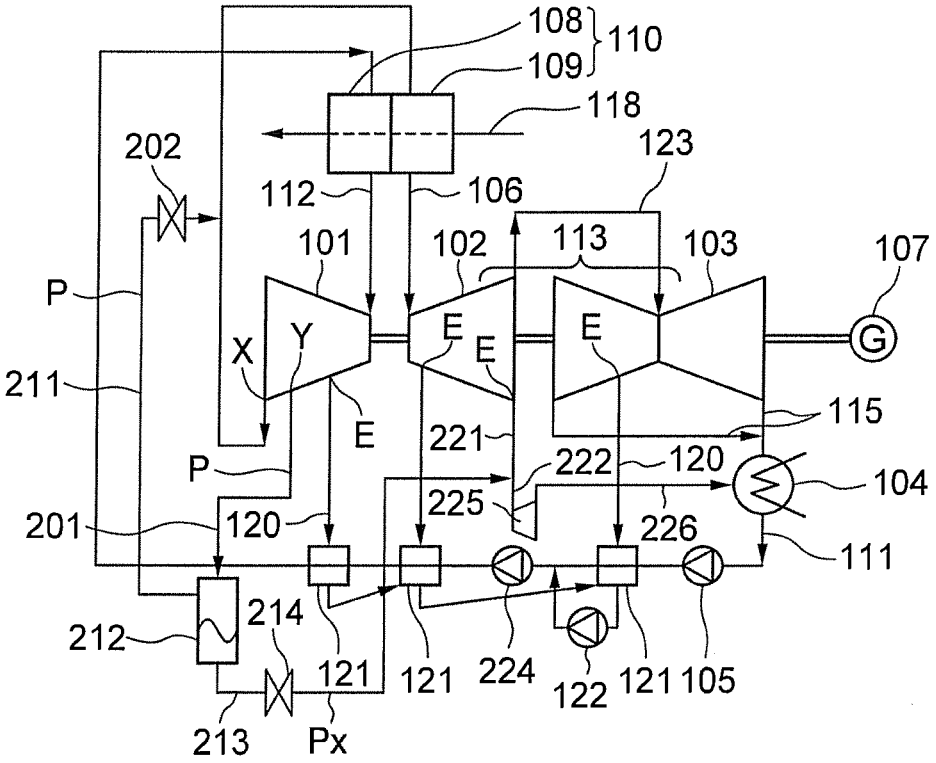
FIG. 21 is a schematic diagram illustrating a configuration of a steam turbine plant of a nineteen embodiment.

FIG. 21 is a schematic diagram illustrating a configuration of the steam turbine plant of the nineteenth embodiment.

In the fifth embodiment (FIG. 7), the liquid 213 is made to flow into the condenser 104 by the separated liquid path Px. On the contrary, in the nineteenth embodiment (FIG. 21), the liquid 213 is made to flow into the feed-water pump driving steam turbine 225 or the extraction passage to the feed-water pump driving steam turbine 225 by the separated liquid path Px. However, the extraction port E to the turbine 225 is set to a place which is located at the downstream of the collection place Y and has a lower pressure.

Since the amount of the collected matter 201 merging with the extraction steam 221 is extremely small compared to the peripheral steam, the collected water changes into steam by being heated by the peripheral steam, and is used as a part of the steam for driving the feed-water pump driving steam turbine 225.

As in FIG. 7, when the liquid 213 is discarded to the condenser 104, sensible heat and pressure of the liquid 213 are wasted. However, in FIG. 21, since the liquid 213 is merged with the extraction steam 221, the heat input amount of the boiler 108 decreases as much as the sensible heat and the pressure of the liquid 213 are not wasted, and deterioration in the performance of the steam turbine cycle is reduced.

Further, in the embodiment, since the liquid 213 is used in the feed-water pump driving steam turbine 225, it is possible to decrease the amount of the extraction steam. Therefore, according to the embodiment, the flow rate of the turbine steam at the downstream of the extraction place of the extraction steam 221 decreases, and the output of the power generation and the performance of the steam turbine cycle improve.

As described above, according to the embodiment, when moisture is removed from the exhaust of the high pressure turbine 101, it is possible to reduce deterioration in the output of the power generation and deterioration in the performance of the steam turbine cycle with the removal of the moisture, as in the seventeenth and eighteenth embodiments.

Twentieth Embodiment

The twentieth embodiment is shown in FIGS. 1 to 6 and FIGS. 12 to 18. Hereinafter, the twentieth embodiment will be described by referring to FIG. 1.

In the embodiment, the collected matter path P is provided with the valve 202 which is an opening/closing valve for stopping the circulation of the collected matter 201 or a pressure adjustment valve for adjusting the flow rate of the collected matter 201.

In the solar power generation, a heat medium 118 stored in a heat storage tank is circulated while bypassing a solar energy collector 119 at nighttime when solar rays 117 (FIG. 22) cannot be received or daytime when the solar rays 117 are weak. Accordingly, the running state of each turbine changes. Further, since the state of the solar rays 117 is different due to the climate, the season, and the time even at daytime the running state of each turbine changes in response thereto.

For this reason, the steam of the outflow place of the collected matter 201 may not be humid steam in accordance with the running state of the turbine. In this case, since the collected matter 201 is not collected, dry steam circulates in the collected matter path P. In this case, the output of the turbine or the performance of the turbine cycle deteriorates. Further, even when the steam of the outflow place of the collected matter 201 is humid steam with low humidity, the collection amount of the moisture becomes smaller and the collection amount of the steam becomes larger, so that the output of the turbine or the performance of the turbine cycle deteriorates.

In this case, in the embodiment, when the valve 202 is fully closed, the output of the turbine or the performance of the turbine cycle may be maintained without any deterioration.

Further, in the embodiment, when the collector is the slit attached stator vane 312, a difference in the suction pressure may be adjusted on the basis of the opening degree of the valve 202. Accordingly, for example, the suction amount of the accompanying steam may be decreased.

In the embodiment, it is possible to adjust a difference in the pressure in accordance with the running state of the turbine. Even when the collector is the drain catcher 304 or the groove attached rotor vane 311 and the drain catcher 304, if the humidity of the steam of the outflow place of the collected matter 201 is small, the steam other than the moisture easily flows outward. Therefore, in this case, when the opening degree of the valve 202 is adjusted and the outflow of the collected matter 201 from the drain catcher 304 is slowed down, it is possible to suppress the outflow of the steam other than the moisture.

As described above, according to the embodiment, it is possible to desirably control the circulation or the flow rate of the collected matter 201 circulating in the collected matter path P by using the valve 202 which is the opening/closing valve or the pressure adjustment valve.

Twenty-First Embodiment

The twenty-first embodiment is shown in FIGS. 7 to 11 and FIGS. 19 to 21. Hereinafter, the twenty-first embodiment will be described by referring to FIG. 7.

In the embodiment, the collected matter path P at the downstream of the gas-liquid separator 212 is provided with the valve 202 which is an opening/closing valve for stopping the circulation of the gas 211 or a pressure adjustment valve for adjusting the flow rate of the gas 211. Further, the separated liquid path Px is provided with a liquid passage valve 214 which is an opening/closing valve for stopping the circulation of the liquid 213 or a pressure adjustment valve for adjusting the flow rate of the liquid 213.

In the embodiment, in accordance with the running state of the turbine, the valve 202 is adjusted to be fully closed or the opening degree thereof is adjusted, and the liquid passage valve 214 is adjusted to be fully closed or the opening degree thereof is adjusted. Accordingly, it is possible to obtain the same effect as that of the twenty-first embodiment. In the embodiment, the opening/closing valve or the pressure adjustment valve may be installed on the collected matter path P from the collection place Y of the collected matter 201 to the gas-liquid separator 212.

As described above, according to the embodiment, it is possible to desirably adjust the circulation or the flow rate of the separated gas 211 and the liquid 213 separated from the collected matter 201 by using the valve 202 and the liquid passage valve 214 which are the opening/closing valve or the pressure adjustment valve.

Twenty-Second Embodiment

The twenty-second embodiment is shown in FIG. 24. The collector of FIG. 24 may be used in combination with any one of the first to thirteenth embodiments and the seventeenth to nineteenth embodiments.

In the embodiment, a drain catcher 304 is installed at the inner wall surface 303 on the outer peripheral side of the casing of the high pressure turbine 101 to collect moisture. Accordingly, it is possible to collect the moisture present in the inner wall surface 303. In the embodiment, there is an advantage in that the collector may be realized with a simple structure.

Twenty-Third Embodiment

Figure 25:
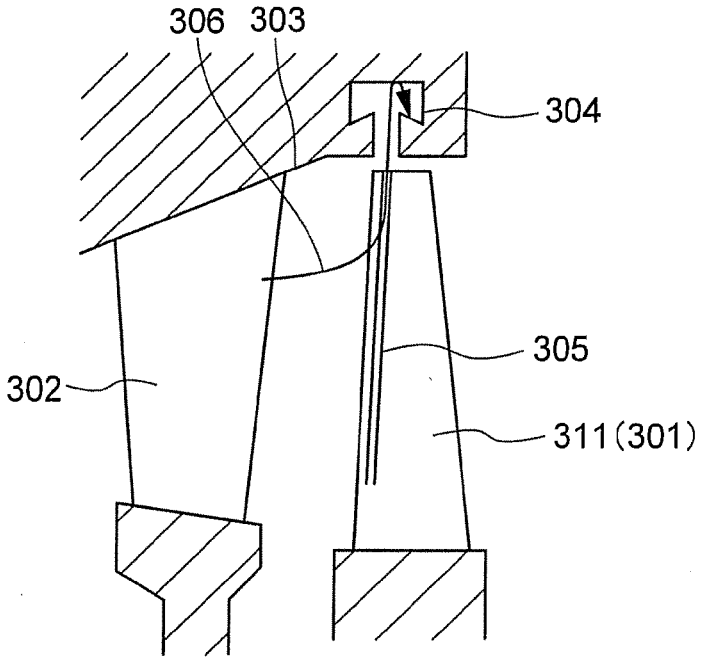
FIG. 25 is a schematic diagram illustrating a second example of a collector.

The twenty-third embodiment is shown in FIG. 25. The collector of FIG. 25 may be used in combination with any one of the first to thirteenth embodiments and the seventeenth to nineteenth embodiments.

In the embodiment, a groove 305 is provided on the surface of the rotor vane 301 of the high pressure turbine 101 in a direction from the inner periphery toward the outer periphery thereof. Further, the drain catcher 304 is provided at the inner wall surface 303 on the outer peripheral side of the casing of the high pressure turbine 101. Accordingly, it is possible to make the moisture collected by the groove 305 fly toward the inner wall surface 303 due to the centrifugal force and collect it by the drain catcher 304. In the embodiment, there is an advantage in that moisture may be more actively removed compared to the twenty-second embodiment.

Twenty-Fourth Embodiment

Figure 26:
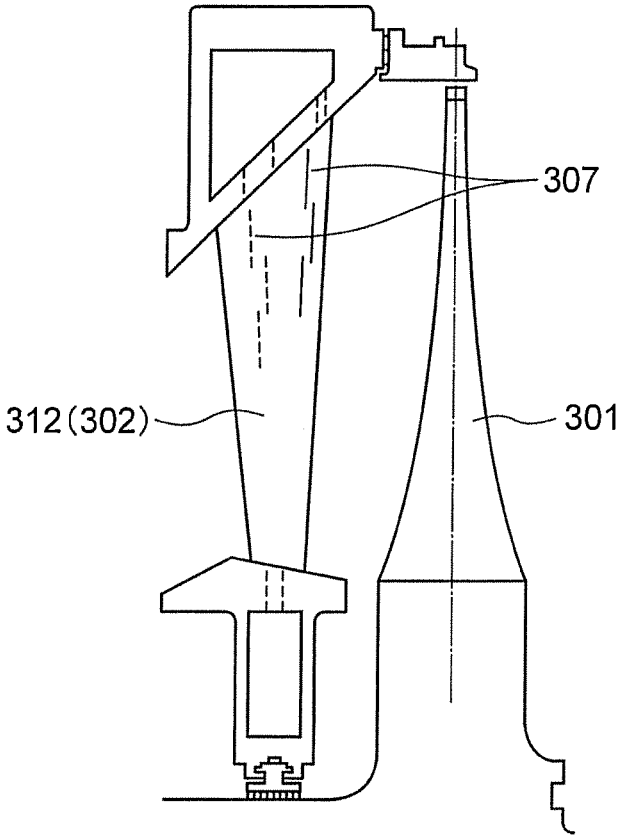
FIG. 26 is a schematic diagram illustrating a third example of a collector.
Figure 27:
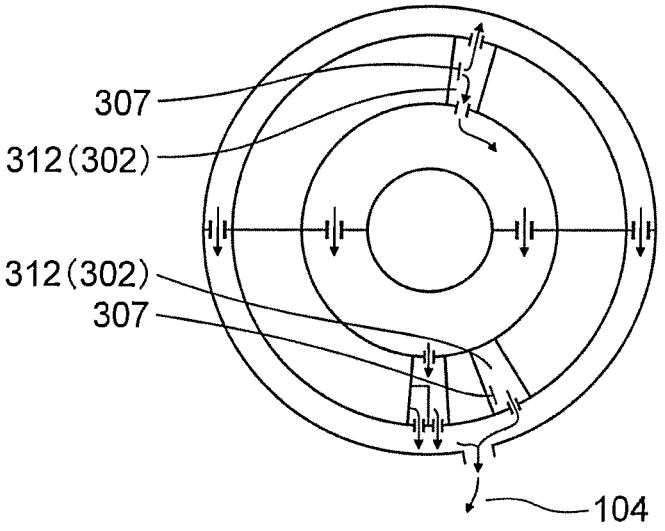
FIG. 27 is another schematic diagram illustrating the third example of the collector.

The twenty-fourth embodiment is shown in FIGS. 26 to 28. The collector of FIGS. 26 to 28 may be used in combination with any one of the first to thirteenth embodiments and the seventeenth to nineteenth embodiments.

In the embodiment, the slit 307 is provided on the surface of the stator vane 302 of the high pressure turbine 101. Further, a passage of a hollow space 308 is provided inside the stator vane 302 to extend from the slit 307 toward the outer periphery thereof. Accordingly, a structure is realized in which the moisture present on the surface of the stator vane 302 is collected and is made to flow to the outside of the high pressure turbine 101.

The moisture or the humid steam present on the surface of the stator vane 302 is suctioned outward by using a difference in the pressure between the outflow place and the inflow place of the collected matter 201. In the embodiment, there is an advantage in that moisture may be more actively removed compared to the twenty-second and twenty-third embodiments.

Further, in the twenty-third embodiment, since the shape of the groove attached rotor vane 311 is not best suitable for the aerodynamic viewpoint, the performance of the steam turbine cycle deteriorates, whereas according to the slit attached stator vane 312 of the embodiment, such deterioration in the performance may be prevented.

Furthermore, in FIGS. 24 to 28, the condenser 104 is shown as the outflow place of the collected matter 201, but it shows a case where the collector of FIGS. 24 to 28 is applied to the steam turbine plant of FIG. 22 or 23. When the collector of FIGS. 24 to 28 is applied to any one of the first to thirteenth embodiments, the outflow place of the collected matter 201 is the place shown in the description of the embodiments.

Twenty-Fifth Embodiment

The twenty-fifth embodiment may be used in combination with any one of the first to nineteenth embodiments.

In the twenty-fifth embodiment, the steam turbine constituting the steam turbine plant is driven by steam generated by solar heat. In the steam turbine plant using solar heat, compared to the steam turbine plant using heat of combustion exhaust of a fuel, the temperature of the turbine inlet steam is low, and the steam at the halfway stage of the turbine easily becomes humid steam.

Further, in the steam turbine plant using solar heat, a reheat cycle is used in many cases. However, in this case, the temperature of the high pressure turbine inlet steam 112 is low, and the high pressure turbine exhaust 114 easily becomes humid steam.

Therefore, the effect of reducing deterioration in the output of the power generation and deterioration in the performance of the steam turbine cycle with the removal of the moisture in the first to nineteenth embodiments may be more effectively exhibited when these embodiments are applied to the solar power generation.

Twenty-Sixth Embodiment

The twenty-sixth embodiment may be used tougher with any one of the first to nineteenth embodiments.

In the twenty-sixth embodiment, the steam turbine constituting the steam turbine plant is a steam turbine used in geothermal power generation. In the steam turbine plant of the geothermal power generation, the humidity of the turbine inlet steam is not zero in many cases, and the humidity thereof becomes higher as the steam moves to the downstream.

Therefore, the effect of reducing deterioration in the output of the power generation and deterioration in the performance of the steam turbine cycle with the removal of the moisture in the first to nineteenth embodiments may be more effectively exhibited when these embodiments are applied to the geothermal power generation in which a large amount of moisture is contained in the steam.

Figure 30A:
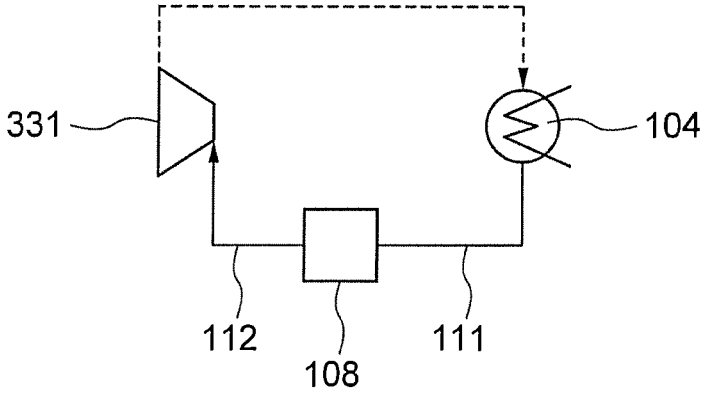
FIGS. 30A and 30B are schematic diagrams illustrating configurations of steam turbine plants for solar power generation and geothermal power generation, respectively.
Figure 30B:
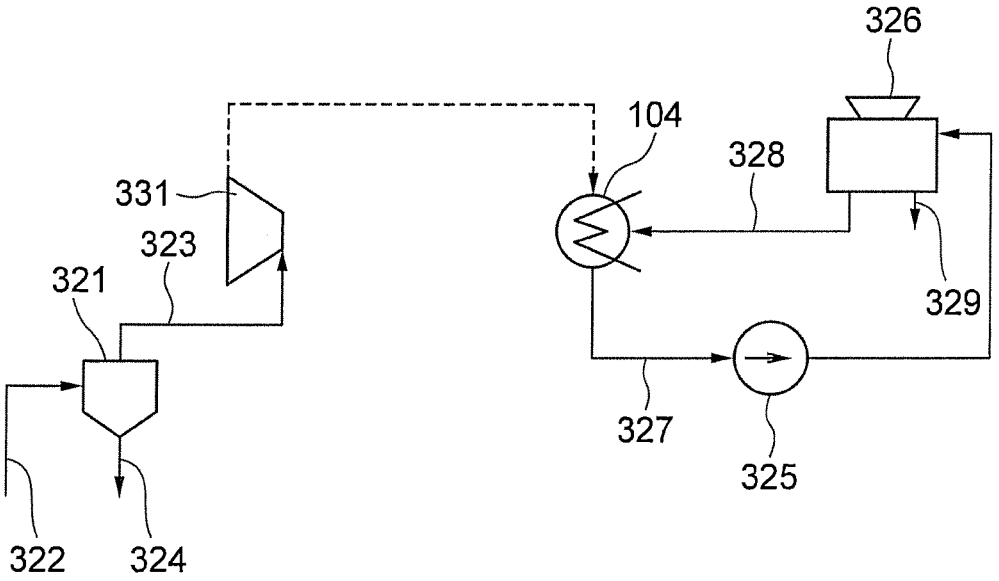

FIGS. 30A and 30B are schematic diagrams illustrating configurations of steam turbine plants for solar power generation and geothermal power generation, respectively. Hereinafter, differences between the configurations of those plants will be described by referring to FIGS. 30A and 30B.

FIGS. 30A and 30B respectively schematically illustrate the configurations of the steam turbine plants for the solar power generation and the geothermal power generation. In FIG. 30A, the water 111 from the condenser 104 is returned to the boiler 108 to be reused, whereas in FIG. 30B, the water 111 from the condenser 104 is not returned to the boiler 108. That is, the steam turbine cycle for the geothermal power generation is an open cycle. Although the steam turbine cycles in FIGS. 30A and 30B are reheat cycles with reheaters (not shown) and the like in practice, such reheaters and the like are omitted for simplicity in FIGS. 30A and 30B.

The steam turbine plant of FIG. 30B includes a separator 321, a hot water pump 325, and a cooling tower 326.

The separator 321 is configured to separate natural steam 322 from a production well into dry steam 323 and hot water 324. The steam 323 is used to drive a turbine group 331 including the high pressure turbine 101, the intermediate pressure turbine 102, and the low pressure turbine 103, and the hot water 323 is returned to a reduction well.

The hot water pump 325 is a pump which transfers the hot water 327 from the condenser 104 to the cooling tower 326. The cooling tower 326 is a structure which cools the hot water 327 through the contact with the atmosphere. The hot water 327 is cooled into the cold water 328 by the cooling tower 326. The cold water 328 is transferred to the condenser 104, and is used to return the steam to the water. Furthermore, the extra cold water 328 is returned as overflow water 329 to the reduction well.

Furthermore, regarding the configuration between the turbine group 331 and the condenser 104 shown in FIGS. 30A and 30B, several configurations shown in FIGS. 1 to 23 may be adopted.

Twenty-Seventh Embodiment

The twenty-seventh embodiment may be adopted together with any one of the first to nineteenth embodiments.

In the twenty-seventh embodiment, the steam turbine constituting the steam turbine plant is a steam turbine used for nuclear power generation. In the steam turbine plant of the nuclear power generation, the humidity of the turbine inlet steam is not zero in many cases, and the humidity thereof becomes higher as the steam moves to the downstream.

When the steam turbine cycle is a reheat cycle, the humidity of the steam right behind the reheater 109 is not zero in many cases. Then, in the stage with many steam turbines behind the reheater 109, the humidity of the steam is not zero, and the humidity thereof becomes higher as the steam moves to the downstream.

Therefore, the effect of reducing deterioration in the output of the power generation and deterioration in the performance of the steam turbine cycle with the removal of the moisture in the first to nineteenth embodiments may be more effectively exhibited when these embodiments are applied to the nuclear power generation in which a considerably large amount of moisture is contained in the steam.

As described above, according to the embodiments of the invention, it is possible to provide the steam turbine plant capable of reducing deterioration in the output of the power generation and deterioration in the performance of the steam turbine cycle with the removal of the moisture when the moisture is removed from the steam inside the high pressure turbine 101 or the exhaust of the high pressure turbine 101.

While examples of specific aspects of the invention have been explained with reference to the first to twenty-seventh embodiments, the invention is not limited to those embodiments.

The invention claimed is:

1. A steam turbine plant comprising:

a boiler configured to change water into steam;

a high pressure turbine including plural stages of rotor vanes and plural stages of stator vanes, and configured to be driven by the steam from the boiler;

a reheater configured to heat the steam exhausted from the high pressure turbine;

a reheat turbine including plural stages of rotor vanes and plural stages of stator vanes, and configured to be driven by the steam from the reheater;

a condenser configured to change the steam exhausted from the reheat turbine into water;

a collector configured to collect water from the steam which exists upstream of an inlet of the final-stage rotor vane in the high pressure turbine, or from the steam exhausted from the high pressure turbine to be provided to the reheater to drive the reheat turbine; and a collected matter path configured to cause collected matter in the collector to flow into:

the steam between an outlet of the final-stage rotor vane of the high pressure turbine and an inlet of the final-stage rotor vane of the reheat turbine, the steam between a collection place of the collected matter and the inlet of the final-stage rotor vane in the high pressure turbine, the steam extracted from an extraction port of the high pressure turbine or the reheat turbine, wherein the collected matter having passed no feed-water heater flows into the extracted steam from the extraction port, a feed-water heater configured to receive the extracted steam from the extraction port through no feed-water heater and heat the water exhausted from the condenser and flowing between the condenser and the boiler by using the extracted steam merged with the collected matter which has passed no feed-water heater, wherein the collector collects the water from the steam which exists upstream of the inlet of the final-stage rotor vane in the high pressure turbine, or a feed-water-pump-driving steam turbine configured to receive the extracted steam from the extraction port and be driven by the extracted steam merged with the collected matter which has passed no feed-water heater.

2. The plant of claim 1, wherein the collected matter path is configured to cause the collected matter to flow into:

a position between the high pressure turbine and the reheater, a position between the reheater and the reheat turbine, an inlet or a halfway stage of the reheat turbine, or the reheater.

3. The plant of claim 1, further comprising a gas-liquid separator disposed on the collected matter path, and configured to separate the collected matter or resultant matter changed from the collected matter into a gas and a liquid, wherein the collected matter path is configured to cause the separated gas to flow into:

the steam between the outlet of the final-stage rotor vane of the high pressure turbine and the inlet of the final-stage rotor vane of the reheat turbine, or the steam between the collection place of the collected matter and the inlet of the final-stage rotor vane in the high pressure turbine.

4. The plant of claim 3, wherein the collected matter path is configured to cause the separated gas to flow into:

a position between the high pressure turbine and the reheater, a position between the reheater and the reheat turbine, an inlet or a halfway stage of the reheat turbine, the reheater, or a position between the collection place of the collected matter and the inlet of the final-stage rotor vane in the high pressure turbine.

5. The plant of claim 1, wherein the collected matter path is configured to cause the collected matter to flow into:

the feed-water heater configured to receive the extracted steam, and to heat the water from the condenser, the feed-water-pump-driving steam turbine disposed between the extraction port and the condenser, and configured to receive the extracted steam, or the extracted steam between the extraction port and the feed-water heater or the feed-water-pump-driving steam turbine.

6. The plant of claim 3, wherein the separated liquid is caused to flow into:

the feed-water heater configured to receive the extracted steam, and to heat the water from the condenser, the feed-water-pump-driving steam turbine disposed between the extraction port and the condenser, and configured to receive the extracted steam, or the extracted steam between the extraction port and the feed-water heater or the feed-water-pump-driving steam turbine.

7. The plant of claim 1, wherein the collector is a moisture separator configured to separate water from the steam exhausted from the high pressure turbine, and to collect at least the separated water as the collected matter, and the collected matter path is configured to cause the collected matter to flow into:

the extracted steam from the extraction port, the feed-water heater configured to receive the extracted steam, or the feed-water-pump-driving steam turbine configured to receive the extracted steam.

8. The plant of claim 7, wherein the collected matter path is configured to cause the collected matter to flow into the feed-water heater configured to receive the extracted steam, and to heat the water from the condenser, the feed-water-pump-driving steam turbine disposed between the extraction port and the condenser, and configured to receive the extracted steam, or the extracted steam between the extraction port and the feed-water heater or the feed-water-pump-driving steam turbine.

9. The plant of claim 1, wherein the collected matter path comprises a valve configured to stop a circulation of the collected matter, or to adjust a flow rate of the collected matter.

10. The plant of claim 3, further comprising a separated liquid path configured to cause the separated liquid to circulate, wherein the collected matter path comprises a valve disposed downstream of the gas-liquid separator, and configured to stop a circulation of the separated gas or to adjust a flow rate of the separated gas, and the separated liquid path comprises a valve configured to stop a circulation of the separated liquid, or to adjust a flow rate of the separated liquid.

11. A steam turbine plant comprising:

a boiler configured to change water into steam;

a high pressure turbine including plural stages of rotor vanes and plural stages of stator vanes, and configured to be driven by the steam from the boiler;

a reheater configured to heat the steam exhausted from the high pressure turbine;

a reheat turbine including plural stages of rotor vanes and plural stages of stator vanes, and configured to be driven by the steam from the reheater;

a condenser configured to change the steam exhausted from the reheat turbine into water;

a collector configured to collect water from the steam which exists upstream of an inlet of the final-stage rotor vane in the high pressure turbine, or from the steam exhausted from the high pressure turbine to be provided to the reheater to drive the reheat turbine; and a collected matter path configured to cause collected matter in the collector to flow into:

the steam between an outlet of the final-stage rotor vane of the high pressure turbine and an inlet of the final-stage rotor vane of the reheat turbine, the steam between a collection place of the collected matter and the inlet of the final-stage rotor vane in the high pressure turbine, the steam extracted from an extraction port of the high pressure turbine or the reheat turbine to a steam path different from the collected matter path, wherein the collected matter having passed no feed-water heater flows into the extracted steam from the extraction port at a merging place of the collected matter path and the steam path, a feed-water heater configured to receive the extracted steam which is exhausted from the extraction port to the steam path different from the collected matter path and has passed no feed-water heater and to heat the water exhausted from the condenser and flowing between the condenser and the boiler by using the extracted steam merged with the collected matter which has passed no feed-water heater, wherein the collector collects the water from the steam which exists upstream of the inlet of the final-stage rotor vane in the high pressure turbine, or a feed-water-pump-driving steam turbine configured to receive the extracted steam from the extraction port and be driven by the extracted steam merged with the collected matter which has passed no feed-water heater.

* * * * *